US009488943B2

(12) United States Patent
Suzuki

(10) Patent No.: US 9,488,943 B2
(45) **Date of Patent: *Nov. 8, 2016**

(54) IMAGE FORMING APPARATUS

(71) Applicant: Brother Kogyo Kabushiki Kaisha, Nagoya-shi, Aichi-ken (JP)

(72) Inventor: Yasuhiro Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/971,390

(22) Filed: Dec. 16, 2015

(65) Prior Publication Data

US 2016/0103406 A1 Apr. 14, 2016

Related U.S. Application Data

(63) Continuation of application No. 14/555,347, filed on Nov. 26, 2014, now Pat. No. 9,239,557.

(30) Foreign Application Priority Data

Nov. 29, 2013 (JP) ..... 2013-246885
Nov. 29, 2013 (JP) ..... 2013-248085

(51) Int. Cl.
*G03G 15/20* (2006.01)

(52) U.S. Cl.
CPC .. *G03G 15/2053* (2013.01); *G03G 2215/2035* (2013.01); *G03G 2221/1657* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,549,803 | A | 10/1985 | Ohno et al. | |
| 6,381,422 | B1 | 4/2002 | Tanaka | |
| 9,239,557 | B2 * | 1/2016 | Suzuki | G03G 15/2053 |
| 2006/0245790 | A1 | 11/2006 | Hamakawa et al. | |
| 2008/0152365 | A1 | 6/2008 | Park et al. | |
| 2011/0085832 | A1 | 4/2011 | Hasegawa et al. | |

FOREIGN PATENT DOCUMENTS

| | | | |
|---|---|---|---|
| JP | S5649459 | A | 5/1981 |
| JP | 2001-282072 | A | 10/2001 |
| JP | 2002-049266 | A | 2/2002 |
| JP | 2004-101925 | A | 4/2004 |
| JP | 2009-134080 | A | 6/2009 |
| JP | 2009-134120 | A | 6/2009 |
| JP | 2013-174632 | A | 9/2013 |

* cited by examiner

*Primary Examiner* — Walter L Lindsay, Jr.
*Assistant Examiner* — Jas Sanghera
(74) *Attorney, Agent, or Firm* — Banner & Witcoff, Ltd.

(57) ABSTRACT

There is provided an image forming apparatus including: an image forming unit; a fixing unit; a motor; a transmission device configured to transmit a driving power from the motor with a speed transmission ratio selectable from a first speed transmission ratio and a second speed transmission ratio; and a control unit configured to control the transmission device to set the speed transmission ratio to one of the first speed transmission ratio and the second speed transmission ratio by controlling the transmission device to switch a connection state being set by a connection mechanism into one of a connected state and a disconnected state.

11 Claims, 17 Drawing Sheets

IMAGE FORMING APPARATUS

CROSS-REFERENCE TO RELATED APPLICATION

This application is a continuation of prior U.S. application Ser. No. 14/555,347, filed Nov. 26, 2014, which claims priorities from Japanese Patent Application Nos. 2013-246885 and 2013-248085, both of which were filed on Nov. 29, 2013, the entire subject matter of which is incorporated herein by reference.

TECHNICAL FIELD

The present invention relates to an image forming apparatus that is provided with a fixing unit configured to convey and heat a sheet delivered from an image forming unit to thus fix an image on the sheet and a motor configured to generate a driving power for driving the fixing unit.

BACKGROUND

Conventionally, there has been known an image forming apparatus configured to keep an amount of slackness of a sheet conveyed through between an image forming unit and a fixing unit within a predetermined range. The image forming apparatus includes a motor configured to generate a driving power for driving a fixing unit, a sensor provided between the image forming unit and the fixing unit and configured to detect an amount of slackness of the sheet and a control unit configured to control a rotating speed of the motor based on a detection result of the sensor and to adjust a conveying speed of the fixing unit.

In order to simplify the entire control of the image forming apparatus, it would be more preferable to configure the image forming apparatus to have a capability to adjust a sheet conveying speed in the fixing unit without controlling the rotating speed of the motor.

SUMMARY OF THE INVENTION

The present disclosure has been made in view of the above circumstances, and one of objects of the present disclosure is to provide an image forming apparatus capable of adjusting a sheet conveying speed in a fixing unit without controlling a rotating speed of a motor.

According to an illustrative embodiment of the present disclosure, there is provided an image forming apparatus including: an image forming unit configured to form an image on a sheet; a fixing unit configured to convey and heat the sheet delivered from the image forming unit to fix the image on the sheet; a motor configured to generate a driving power for driving the fixing unit; a transmission device configured to transmit the driving power from the motor with a speed transmission ratio selectable from a first speed transmission ratio and a second speed transmission ratio that is greater than the first speed transmission ratio; and a control unit. The transmission device is provided with: a planetary gear mechanism and a connection mechanism. The planetary gear mechanism is provided with a first element and a second element being configured to receive the driving power from the motor and a third element being configured to compose the driving power received through the first element and the second element as a composed driving power and to output the composed driving power to the fixing unit, wherein the first element, the second element and the third element are configured by a group of elements comprising a sun gear, a carrier and a ring gear. The connection mechanism is configured to set a connection state between the motor and the planetary gear mechanism into one of a connected state in which the driving power from the motor is transmitted to the second element and a disconnected state in which the driving power from the motor is not transmitted to the second element. The control unit is configured to control the transmission device to set the speed transmission ratio to one of the first speed transmission ratio and the second speed transmission ratio by controlling the transmission device to switch the connection state being set by the connection mechanism into one of the connected state and the disconnected state.

According to an illustrative embodiment of the present disclosure, there is provided an image forming apparatus including: an image forming unit configured to form an image on a sheet; a fixing unit configured to convey and heat the sheet delivered from the image forming unit to fix the image on the sheet; a motor configured to generate a driving power for driving the fixing unit; a transmission device comprising a first drive train having a first speed transmission ratio and a second drive train having a second speed transmission ratio being set to be greater than the first speed transmission ratio, the transmission device being configured to selectively transmit the driving power of the motor to the fixing unit through one of the first drive train and the second drive train; and a control unit configured to control the transmission device to selectively operate in one of a first mode in which the driving power of the motor is transmitted to the fixing unit through the first drive train and a second mode in which the driving power of the motor is transmitted to the fixing unit through the second drive train.

BRIEF DESCRIPTION OF THE DRAWINGS

In the accompanying drawings:

FIGS. 4A and 4B illustrate a planetary gear mechanism of the transmission mechanism according to the first example, in which FIG. 4A illustrates the planetary gear mechanism as seen from one side in an axial direction, and FIG. 4B illustrates an attachment plate having the planetary gear mechanism and a rotation restraint mechanism attached thereto, as seen from the other side in the axial direction;

FIGS. 5A and 5B illustrate states of an electromagnetic clutch of the transmission mechanism according to the first example, in which FIG. 5A is a sectional view illustrating a disconnected state of the electromagnetic clutch and FIG. 5B is a sectional view illustrating a connected state of the electromagnetic clutch;

FIGS. 6A to 6D illustrate states of the transmission mechanism according to the first example, in which FIG. 6A illustrates a disconnected state, FIG. 6B illustrates a connected state switched from the disconnected state, FIG. 6C illustrates the connected state and FIG. 6D illustrates the disconnected state switched from the connected state;

FIGS. 9A and 9B are enlarged views of a one-way clutch of the transmission mechanism according to the modified embodiment of the first example, in which FIG. 9A is an enlarged view of the one-way clutch as seen from one side in an axial direction and FIG. 9B is an enlarged view of the one-way clutch as seen from above and below;

FIGS. 13A and 13B are sectional views illustrating a configuration of an electromagnetic clutch of the transmission mechanism according to the second example, in which FIG. 13A illustrates a disconnected state and FIG. 13B illustrates a connected state;

FIGS. 14A and 14B illustrate a one-way clutch of the transmission mechanism according to the second example, in which FIG. 14A is a front view of the one-way clutch and FIG. 14B is a side view of the one-way clutch;

FIGS. 17A and 17B illustrate a modified embodiment of the transmission mechanism according to the second example, in which FIG. 17A illustrates the transmission mechanism when the first mode is selected and FIG. 17B illustrates the transmission mechanism when the second mode is selected.

DETAILED DESCRIPTION

Hereinafter, illustrative embodiments of the present invention will be described in detail with reference to the drawings. In below descriptions, an overall configuration of a color printer 1, which is an example of the image forming apparatus, will be first described and then features of the present invention will be described in detail.

In the below descriptions, the directions are described based on a user who uses the color printer 1. That is, the right side of FIG. 1 is referred to as the 'front side,' the left side of FIG. 1 is referred to as the 'rear side,' the inner side of FIG. 1 is referred to as the 'right side' and the front side of FIG. 1 is referred to as the 'left side.' Also, the upper and lower directions of FIG. 1 are referred to as the 'upper-lower direction.'

Figure 1:
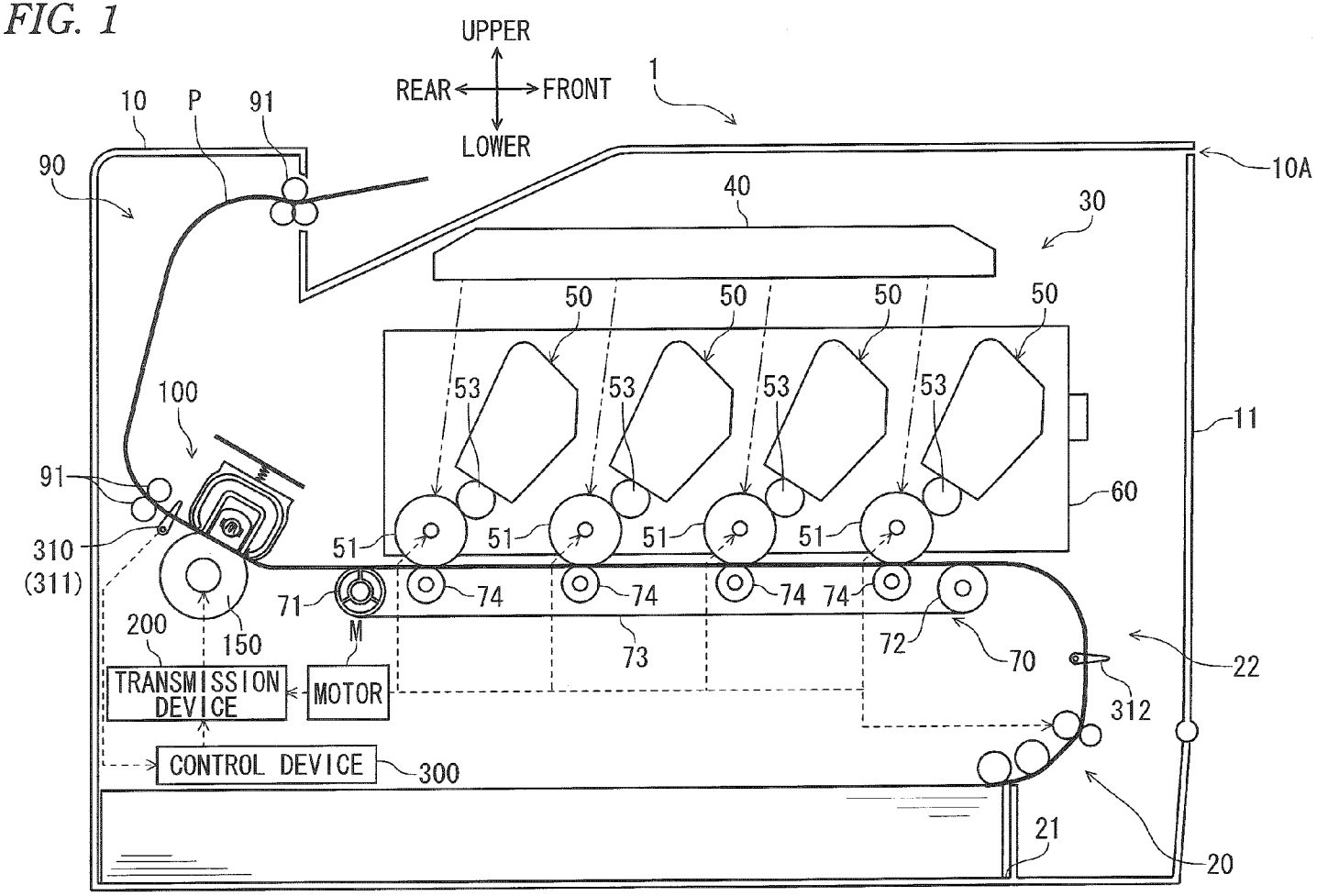
FIG. 1 illustrates a schematic configuration of a color printer according to an illustrative embodiment.

As shown in FIG. 1, the color printer 1 has, in an apparatus main body 10, a feeding unit 20 configured to feed a sheet P, which is an example of a sheet, an image forming unit 30 configured to form an image on the fed sheet P, a fixing unit 100, a sheet discharge unit 90 configured to discharge the sheet P having an image formed thereon, a transmission mechanism 200, a control device 300, which is an example of a control unit, and a motor M. The transmission mechanism 200 and the control device 300 will be described later.

The feeding unit 20 is provided with sheet feeding tray 21 configured to accommodate therein the sheet P and a sheet conveyance mechanism 22, which is an example of a sheet conveyance unit configured to convey the sheet P from the sheet feeding tray 21 to the image forming unit 30.

The image forming unit 30 is provided with scanner unit 40, four process cartridges 50, a holder 60 and a transfer unit 70.

The scanner unit 40 is provided at an upper part in the apparatus main body 10 and is provided with laser light emitting unit, a polygon mirror, a lens, a reflector and the like, which are not shown. In the scanner unit 40, laser beams pass through paths shown with the dashed-two dotted lines in FIG. 1 and are illuminated to surfaces of photosensitive drums 51 by a high-speed scanning.

The process cartridges 50 are aligned in a front-rear direction above the feeding unit 20 and have a photosensitive drum 51, which is an example of a photosensitive member, a well-known charger (not shown), a developing roller 53, a toner accommodation chamber and the like, respectively.

The holder 60 is configured to hold the four process cartridges 50 and can be moved in the front-rear direction through an opening 10A that is formed by opening a front cover 11 disposed on a front surface of the apparatus main body 10.

The transfer unit 70 is provided between the feeding unit 20 and the four process cartridges 50, and is provided with driving roller 71, a driven roller 72, a conveyance belt 73 and transfer rollers 74.

The driving roller 71 and the driven roller 72 are arranged in parallel with being spaced in the front-rear direction, and the conveyance belt 73 is provided with being tensioned therebetween. Also, the four transfer rollers 74 configured to interpose the conveyance belt 73 between the transfer rollers 74 and the respective photosensitive drums 51 are arranged to face the respective photosensitive drums 51 at an inner side of the conveyance belt 73.

The fixing unit 100 is disposed at the rear of the process cartridges 50 and the transfer unit 70, and is configured to convey and heat the sheet P delivered from the image forming unit 30, thereby fixing the image on the sheet P. Also, the fixing unit 100 is configured to be driven by the driving power generated from the motor M.

In the image forming unit 30 configured as described above, the surfaces of the respective photosensitive drums 51 are uniformly charged by the chargers and are then exposed by the scanner unit 40. Thereby, electrostatic latent images based on image data are formed on the respective photosensitive drums 51. After that, toners in the toner accommodation chambers are supplied to the electrostatic latent images on the photosensitive drums 51 by the developing rollers 53, so that toner images are carried on the photosensitive drums 51.

Then, the sheet P fed onto the conveyance belt 73 passes between the respective photosensitive drums 51 and the respective transfer rollers 74, so that the toner images formed on the respective photosensitive drums 51 are transferred to the sheet P. Then, the toner images transferred to the sheet P are heat-fixed by the fixing unit 100.

Also, a sheet passing sensor 310, which is an example of a sensor configured to detect passing of the sheet P, is disposed at a downstream position, which is adjacent to the fixing unit 100, of the fixing unit 100 with respect to a conveyance path of the sheet P. In the meantime, the sheet passing sensor 310 is provided with well-known structure and includes a detection arm 311 configured to swing by a contact with the sheet P and an optical sensor configured to detect the swinging of the detection arm 311.

The sheet discharge unit 90 mainly is provided with plurality of conveyance rollers 91 configured to convey the sheet P. The sheet P having the toner images transferred and heat-fixed thereto is conveyed by the conveyance rollers 91 and is discharged to an outside of the apparatus main body 10.

Figure 2:
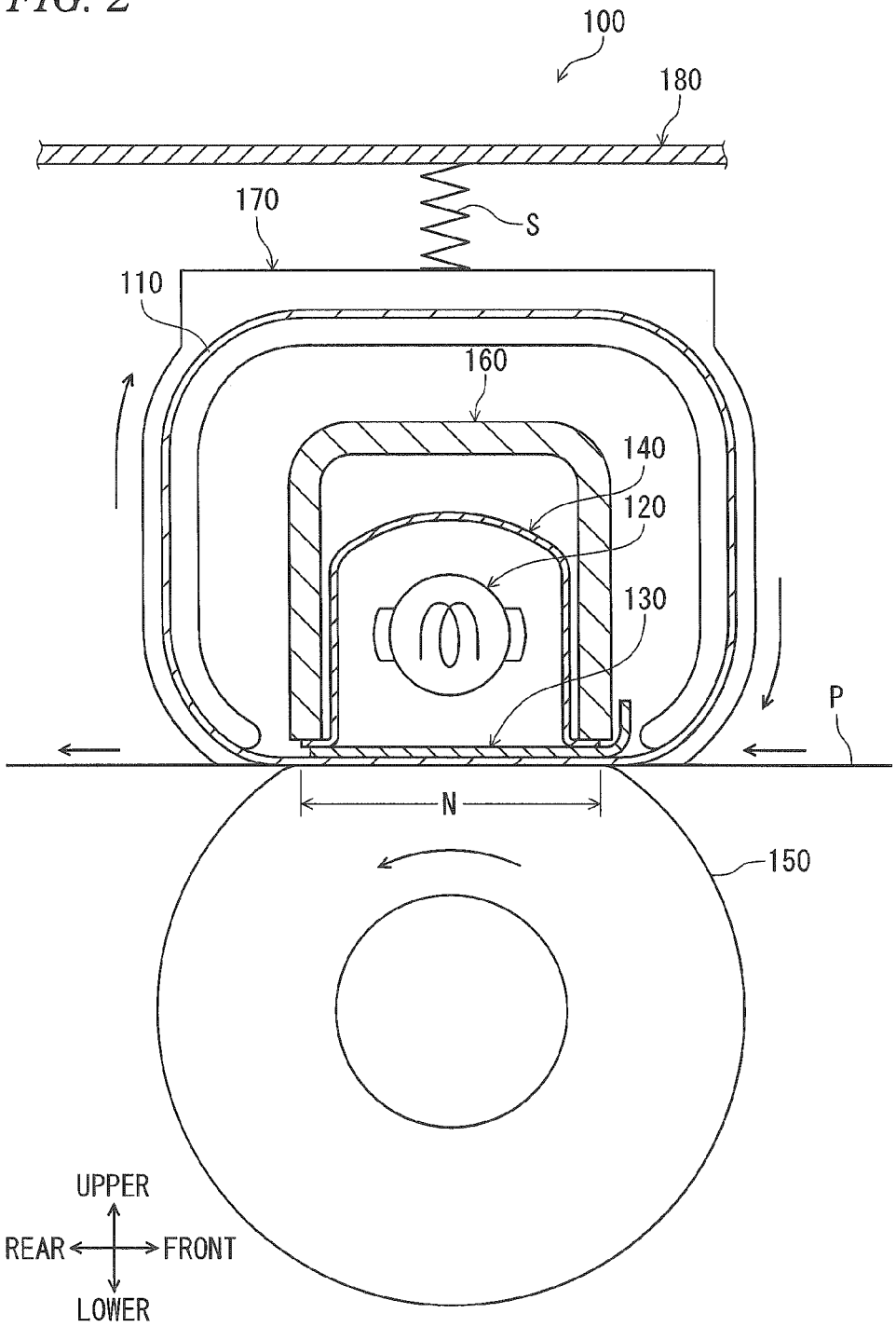
FIG. 2 is a sectional view of a fixing unit.

As shown in FIG. 2, the fixing unit 100 mainly is provided with fixing belt 110, which is an example of a belt, a halogen lamp 120, which is an example of a heat source, a nip plate 130, a reflection plate 140, a pressing roller 150, a stay 160, guide members 170 (only one is shown) and a fixing frame 180. In the meantime, the fixing belt 110, the halogen lamp 120, the nip plate 130, the reflection plate 140, the stay 160 and the guide members 170 are examples of a heating unit.

The fixing belt 110 is an endless belt having heat resistance and flexibility, and is configured to contact the pressing roller 150 and to be rotated by a driving power from the pressing roller 150.

The halogen lamp 120 is a well-known heat generation member configured to heat the nip plate 130 and the fixing belt 110 to thus heat the toners on the sheet P, and is disposed at a predetermined interval from inner surfaces of the fixing belt 110 and the nip plate 130 at an inner side of the fixing belt 110.

The nip plate 130 is a plate-shaped member to which radiation heat from the halogen lamp 120 is applied, and is configured to contact an inner periphery of the fixing belt 110. The nip plate 130 is formed of a material having thermal conductivity higher than the steel stay 160, for example, an aluminum plate, and is configured to transfer the radiation heat from the halogen lamp 120 to the toners on the sheet P through the fixing belt 110.

The reflection plate 140 is a member configured to reflect the radiation heat from the halogen lamp 120 towards the nip plate 130, and is arranged to surround the halogen lamp 120 at the inner side of the fixing belt 110.

The pressing roller 150 is a member configured to rotate with contacting an outer periphery of the fixing belt 110 and to form a nip N between the fixing belt 110 and the pressing roller. The pressing roller 150 is disposed below the fixing belt 110 and is configured to hold the sheet P between the fixing belt 110 and the pressing roller.

The stay 160 is a member configured to support the nip plate 130 with the reflection plate 140 being interposed therebetween and to secure stiffness of the nip plate 130, and is disposed to cover the reflection plate 140.

The guide members 170 are respectively disposed at both ends of the fixing belt 110 in the left-right direction to guide the inner periphery of the fixing belt 110.

The guide member 170 is arranged on the fixing frame 180 so that it can be moved in the upper-lower direction, and is urged towards the pressing roller 150 by a coil spring S that is an example of an urging member provided for the fixing frame 180.

Subsequently, the transmission mechanism 200 of a first example is described.

Figure 3:
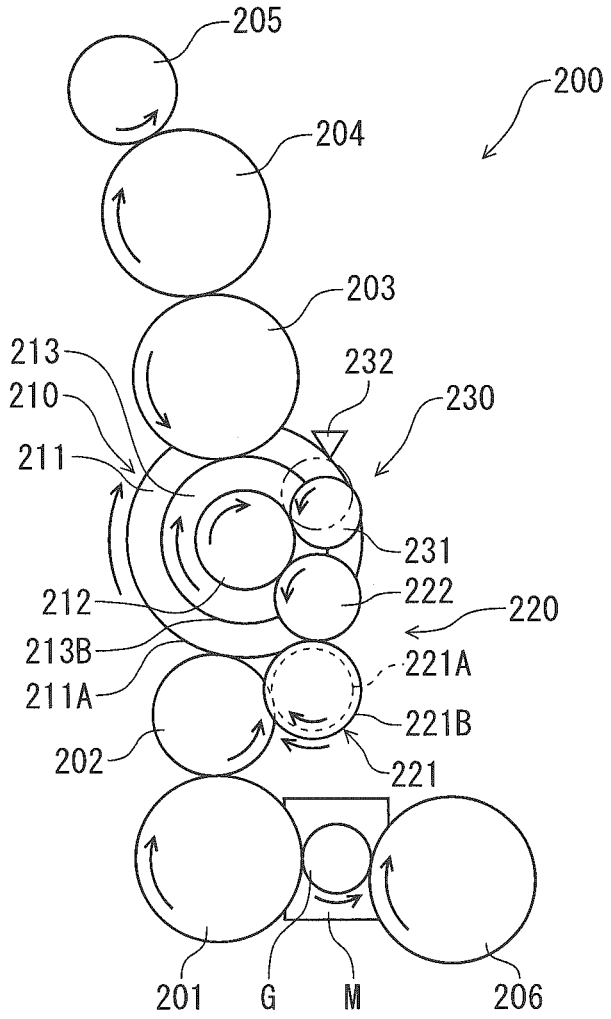
FIG. 3 illustrates a transmission mechanism according to a first example, in which the entire transmission mechanism at a connected state is shown.

As shown in FIG. 3, the transmission mechanism 200 is a mechanism consisting of a plurality of gears and configured to transfer the driving power generated from the motor M to the fixing unit 100 with any one of a first speed transmission ratio and a second speed transmission ratio greater than the first speed transmission ratio. The transmission mechanism 200 is provided with first driving power input gear 201, a transmission gear 202, a planetary gear mechanism 210, a connection mechanism 220, a rotation restraint mechanism 230, a first intermediate gear 203, a second intermediate gear 204 and a pressing roller gear 205.

The first driving power input gear 201 is a gear configured to mesh with a driving gear G configured to rotate integrally with a rotary shaft of the motor M. Meanwhile, in this illustrative embodiment, the driving gear G is also meshed with a second driving power input gear 206. The second driving power input gear 206 is a gear configured to transmit the driving power to the photosensitive drums 51, the sheet conveyance mechanism 22 and the driving roller 71 of the transfer unit 70 through a plurality of gear trains (not shown). That is, the driving power of the motor M is also transmitted to other units such as the photosensitive drums 51 and the sheet conveyance mechanism 22.

The transmission gear 202 is a gear configured to mesh with the first driving power input gear 201, thereby transmitting the driving power of the motor M to the planetary gear mechanism 210 and the connection mechanism 220. The first intermediate gear 203 is a gear configured to connect with the planetary gear mechanism 210, the second intermediate gear 204 is a gear configured to mesh with the first intermediate gear 203 and the pressing roller gear 205, and the pressing roller gear 205 is a gear configured to rotate integrally with the pressing roller 150.

Figure 4A:
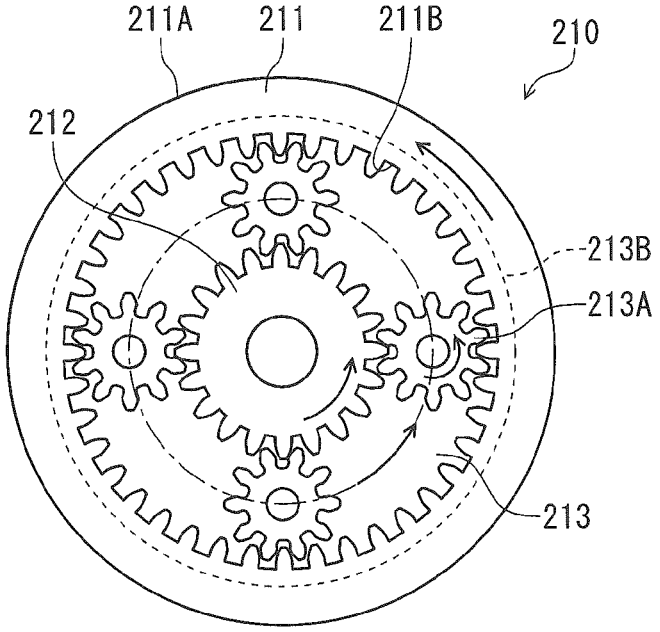
Figure 4B:
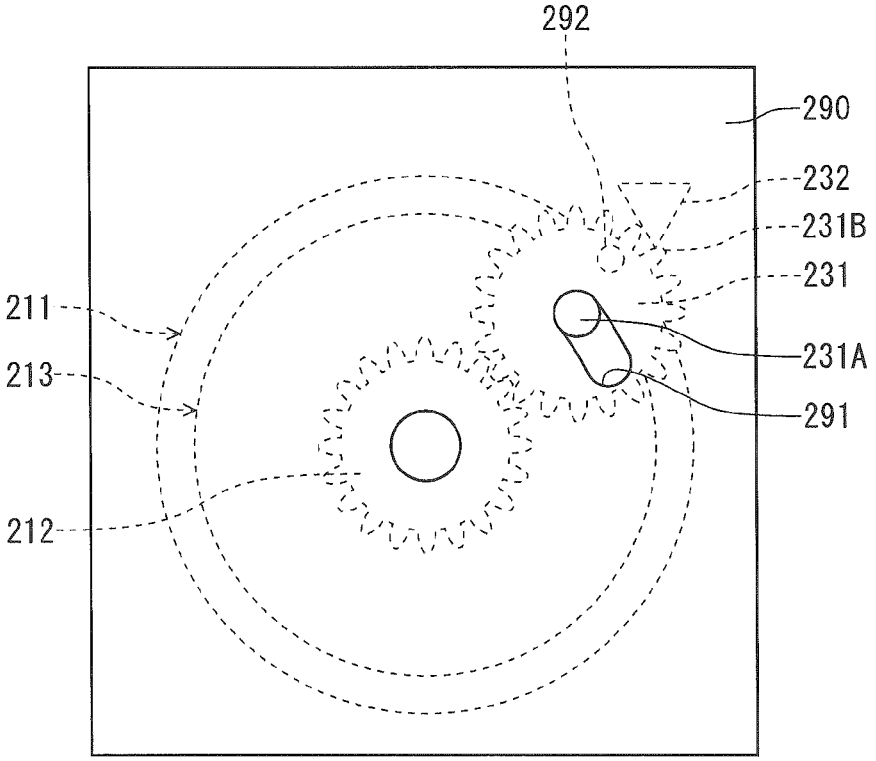

The planetary gear mechanism 210 is a gear mechanism having three elements, i.e., a ring gear 211, which is an example of a first element, a sun gear 212, which is an example of a second element, and a carrier 213, which is an example of a third element, and is held to the attachment plate 290 (refer to FIG. 4B).

As shown in FIG. 4A, the ring gear 211 is provided with an external tooth part 211A (not shown) provided on an outer periphery thereof and an internal tooth part 211B provided on an inner periphery thereof. The ring gear 211 is configured so that the external tooth part 211A meshes with the transmission gear 202 (refer to FIG. 3). Thereby, the driving power from the motor M is transmitted to the external tooth part 211A.

The sun gear 212 is provided with diameter smaller than the inner periphery of the ring gear 211 and is disposed at a position coaxial with a center of rotation of the ring gear 211 and deviating from the internal tooth part 211B of the ring gear 211. The sun gear 212 is connected to the connection mechanism 220 (refer to FIG. 3) so that the driving power from the motor M is transmitted thereto through the connection mechanism 220.

The carrier 213 is configured to rotatably hold four planetary gears 213A configured to mesh with the internal tooth part 211B of the ring gear 211 and the sun gear 212. Also, the carrier 213 is configured to rotate as the planetary gears 213A freely spin the sun gear 212 along an orbit shown with the dashed-dotted line. That is, the carrier 213 is configured so that the driving power from the motor M is transmitted thereto from the ring gear 211 and the sun gear 212 through the planetary gears 213A.

The carrier 213 is provided with circular outer periphery having a diameter smaller than the outer periphery of the ring gear 211 and an external tooth part 213B is provided on the outer periphery thereof. The external tooth part 213B is configured to mesh with the first intermediate gear 203 and to output the driving power transmitted from the ring gear 211 and sun gear 212 to the pressing roller gear 205 through the first intermediate gear 203 and the second intermediate gear 204. That is, the driving power output from the carrier 213 is input to the pressing roller 150.

An operation of the planetary gear mechanism 210 is described. For example, when the driving power of the motor M is input to both the ring gear 211 and the sun gear 212 (refer to FIG. 6B), the carrier 213 is input with the driving powers from the ring gear 211 and the sun gear 212 and outputs a composed driving power of the respective driving powers to the pressing roller 150. Meanwhile, in this illustrative embodiment, the ring gear 211 and the sun gear 212 are configured to rotate in the same direction.

Figure 6A:
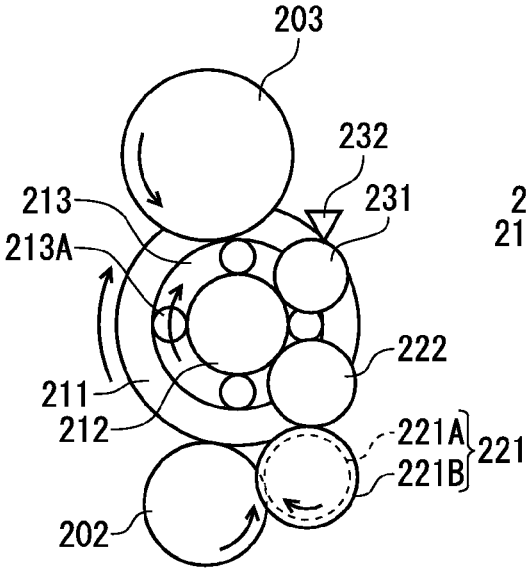

Also, when the driving power of the motor M is input to only the ring gear 211 and the sun gear 212 is enabled to stop (refer to FIG. 6A), the carrier 213 is input with the driving power from only the ring gear 211 and outputs the driving power to the pressing roller 150. A rotating speed of the pressing roller 150 at the state shown in FIG. 6A is reduced as the driving power from the motor M is not transmitted through the sun gear 212, as compared to a rotating speed of the pressing roller 150 at the state shown in FIG. 6B.

As shown in FIG. 3, the connection mechanism 220 is a mechanism configured to select a connected state where the driving power from the motor M is transmitted to the sun gear 212 and a disconnected state where the driving power from the motor M is not transmitted to the sun gear 212, and is provided with an electromagnetic clutch 221 and a connection gear 222.

Figure 5A:
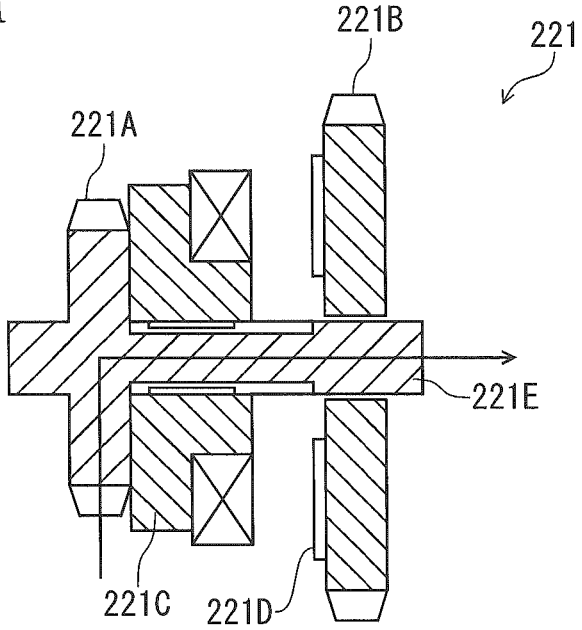

As shown in FIG. 5A, the electromagnetic clutch 221 is provided with an input gear 221A, which is an example of an input shaft configured to mesh with the transmission gear 202, an output gear 221B, which is an example of an output shaft configured to mesh with the sun gear 212 via the connection gear 222, a moving core 221C and a fixed core 221D.

The input gear 221A is a gear to which the driving power from the motor M is input, and integrally is provided with rotary shaft 221E extending in an axis line direction thereof.

The output gear 221B is a gear configured to output the driving power from the motor M to the sun gear 212 through the connection gear 222, and is rotatably mounted to the rotary shaft 221E through a bearing (not shown).

The moving core 221C is disposed between the input gear 221A and the output gear 221B and is wound with coils. The moving core 221C is engaged with the rotary shaft 221E via a spline or serration, and is configured to be axially movable with respect to the rotary shaft 221E and to be rotatable integrally with the rotary shaft 221E. Also, the moving core 221C is urged towards a direction separating from the input gear 221A by an urging member (not shown).

Figure 5B:
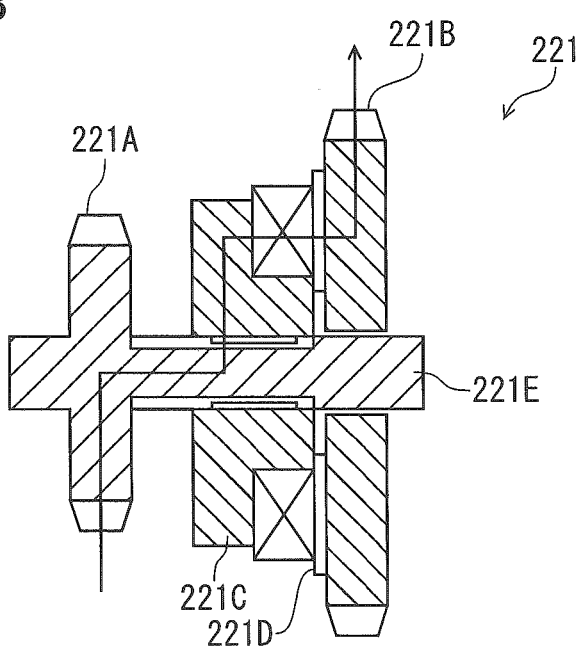

The fixed core 221D is fixed to an end face of the output gear 221B facing the moving core 221C. For this reason, when the moving core 221C is activated, the moving core 221C is moved towards the output gear 221B by an electromagnetic suction force and is sucked to the fixed core 221D, as shown in FIG. 5B. Then, the moving core 221C and the output gear 221B are integrated and the input gear 221A and the output gear 221B are integrally rotated. That is, the connection mechanism 220 is at the connected state, so that the driving power transmitted to the input gear 221A from the motor M is transmitted to the sun gear 212.

In this way, when the connection mechanism 220 is at the connected state, the driving power transmitted from the planetary gear mechanism 210 becomes a composed driving power of the respective driving powers transmitted to the carrier 213 from the ring gear 211 and the sun gear 212. In other words, the transmission mechanism 200 is configured to transmit the driving power from the motor M to the fixing unit 100 with the first speed transmission ratio. The speed transmission ratio is a value obtained by an angular velocity of an input gear/an angular velocity of an output gear. That is, at this time, an angular velocity of the first driving power input gear 201/an angular velocity of the pressing roller gear 205 is the first speed transmission ratio.

Also, when the moving core 221C is not activated, the moving core 221C and the fixed core 221D are not sucked and the input gear 221A and the output gear 221B are at the disconnected state, as shown in FIG. 5A, so that the input gear 221A and the output gear 221B are not integrally rotated. That is, the connection mechanism 220 is at the disconnected state, so that the driving power transmitted to the input gear 221A from the motor M is not transmitted to the sun gear 212.

As shown in FIG. 3, the rotation restraint mechanism 230 is a mechanism configured to restrain the rotation of the sun gear 212 when the connection mechanism 220 is at the disconnected state, and is provided with swinging gear 231 and an engaging part 232.

The swinging gear 231 is a gear configured to mesh with the sun gear 212 and to swing along the periphery of the sun gear 212. More specifically, as shown in FIGS. 3 and 4B, a rotary shaft 231A of the swinging gear 231 is shaft-arranged on an arc-shaped long hole 291 formed at the attachment plate 290 so that the swinging gear 231 can be moved to a connection position (a position shown with the solid line in FIG. 3) when the connection mechanism 220 is at the connected state and to a disconnection position (a position shown with the dashed-two dotted line in FIG. 3) slightly higher than the connection position when the connection mechanism 220 is at the disconnected state.

The swinging gear 231 is urged towards the attachment plate 290 by a coil spring 292 fixed to an attachment plate (not shown) disposed at an opposite side to the attachment plate 290.

The engaging part 232 is configured to engage with the swinging gear 231, thereby restraining the rotation of the swinging gear 231. The engaging part 232 is provided with triangular shape of which a tip protrudes downwardly. The engaging part 232 is disposed so that the tip is engaged with gear teeth 231B of the swinging gear 231 when the swinging gear 231 is at the disconnection position.

Operations of the rotation restraint mechanism 230 are described with reference to FIGS. 6A to 6D.

As shown in FIG. 6A, when the transmission mechanism 200 is at the disconnected state, the electromagnetic clutch 221 is not activated, so that the driving power is not transmitted to the output gear 221B and the swinging gear 231 is located at the disconnection position.

Figure 6B:
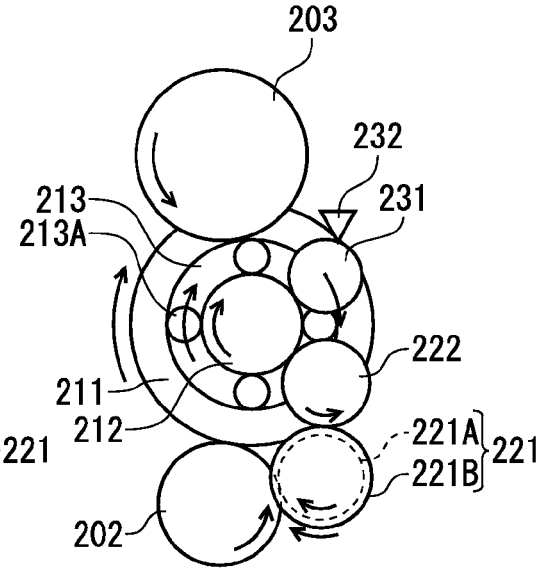

When the electromagnetic clutch 221 is activated and the connection mechanism 220 is thus at the connected state, the driving power is transmitted to the output gear 221B, so that the sun gear 212 is rotated in a clockwise direction, as shown in FIG. 6B. As the sun gear 212 is rotated, the swinging gear 231 is moved downwardly, i.e., from the disconnection position towards the connection position. When the swinging gear 231 reaches the connection position, as shown in FIG. 6C, the swinging gear 231 freely spins at the connection position.

Figure 6C:
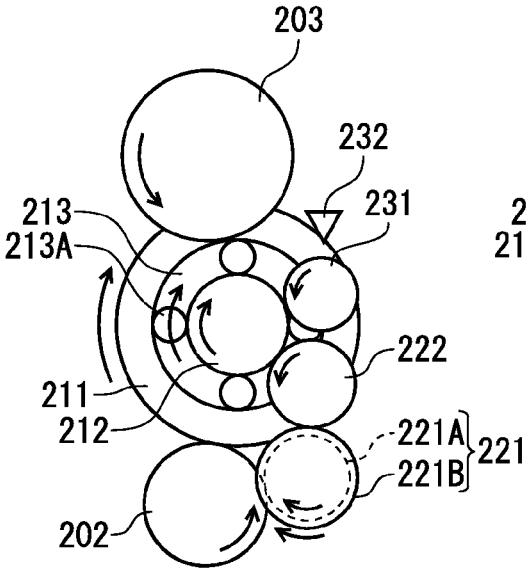
Figure 6D:
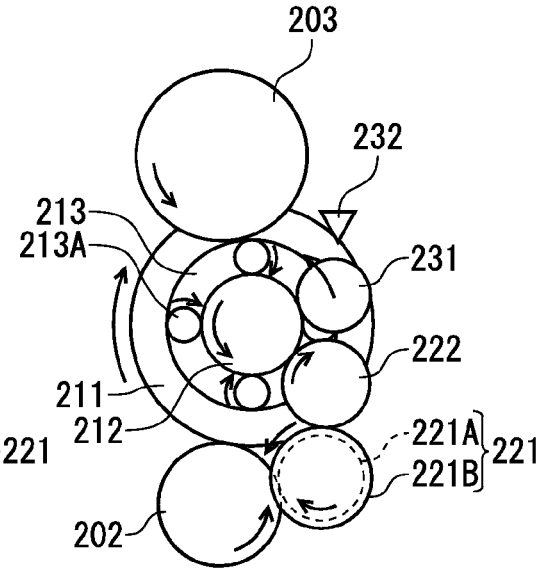

Then, from the state of FIG. 6C, when the activation of the electromagnetic clutch 221 is cut off and the transmission mechanism 200 is thus at the disconnected state, the driving power is not transmitted from the electromagnetic clutch 221 to the sun gear 212, so that the sun gear 212 is applied with the force from the planetary gears 213A configured to rotate in the clockwise direction in conjunction with the rotation of the ring gear 211 and thus starts to rotate in a counterclockwise direction, as shown in FIG. 6D. The swinging gear 231 starts to move upwardly in conjunction with the rotation of the sun gear 212.

When the swinging gear 231 is moved upwardly and contacted to the engaging part 232, the swinging gear 231 and the engaging part 232 are engaged from a direction orthogonal to the rotary shaft, as shown in FIG. 6A, and the rotation of the swinging gear 231 is thus restrained (refer to FIG. 4B). In conjunction with the restraint, the rotation of the sun gear 212 meshed with the swinging gear 231 is also restrained, so that the sun gear 212 is stopped.

When the rotation of the sun gear 212 is restrained and the sun gear 212 is thus stopped, the driving power output from the planetary gear mechanism 210 is transmitted from the ring gear 211 to the carrier 213. In other words, the transmission mechanism 200 is configured to transmit the driving power from the motor M to the fixing unit 100 with the second speed transmission ratio. That is, at this time, an angular velocity of the first driving power input gear 201/an angular velocity of the pressing roller gear 205 is the second speed transmission ratio. As compared to the angular velocity of the pressing roller gear 205 at the time of the first speed transmission ratio, the angular velocity of the pressing roller gear 205 at the time of the second speed transmission ratio is reduced as the driving power from the sun gear 212 is not transmitted. For this reason, the second speed transmission ratio is greater than the first speed transmission ratio.

In this way, the transmission mechanism 200 is configured to change the driving power to be transmitted to the fixing unit 100 without changing the rotating speed of the motor M by selecting any of the first speed transmission ratio and the second speed transmission ratio.

Subsequently, details of the control device 300 are described.

The control device 300 is provided with CPU, a ROM, a RAM and the like, for example, and is configured to execute calculation processing based on a detection signal of the sheet passing sensor 310, a prepared program and the like, thereby to control the transmission mechanism 200.

The control device 300 is configured to execute a selection control of selecting any one of the first speed transmission ratio and the second speed transmission ratio. Specifically, the control device 300 selects the first speed transmission ratio when a time period during which the sheet P having a predetermined length passes through the sheet passing sensor 310 is greater than a first time T1, which is an example of a third threshold, and selects the second speed transmission ratio when a time period during which the sheet P having a predetermined length passes through the sheet passing sensor 310 is less than a second time T2, which is an example of a fourth threshold. The configuration of comparing the time period during which the sheet P having a predetermined length passes through the sheet passing sensor 310 and the respective thresholds corresponds to a configuration of comparing the conveyance speed of the sheet P and the respective thresholds.

Meanwhile, in this illustrative embodiment, the first time T1 is set to be greater than the second time T2. However, the first time T1 and the second time T2 may be set to be the same. Also, the first time T1 and the second time T2 can be appropriately changed depending on a size of the sheet P and can be appropriately set by a user's input of the size of the sheet P, and the like. Also, the first time T1 and the second time T2 may be set based on a time period during which the sheet passes through a second sheet passing sensor 312 disposed at an upstream side of the sheet passing sensor 310 with respect to the conveyance path. By doing so, it is possible to set the first time T1 and the second time T2 without inputting the size of the sheet P. The second sheet passing sensor 312 may also be disposed between the sheet conveyance mechanism 22 and the image forming unit 30.

When selecting the first speed transmission ratio, the control device 300 executes a control of setting the connection mechanism 220 to the connected state, i.e., activating the electromagnetic clutch 221, and when selecting the second speed transmission ratio, the control device 300 executes a control of setting the connection mechanism 220 to the disconnected state, i.e., cutting off the activation of the electromagnetic clutch 221.

The control device 300 executes the selection control when the fixing unit 100 does not convey the sheet P. Specifically, for example, the control device 300 executes the selection control after the sheet passing sensor 310 detects the passing time of the sheet P until a next sheet P is conveyed. Thereby, since the conveying speed is not varied upon the fixing of the sheet P, it is possible to stabilize the fixing operation.

Figure 7:
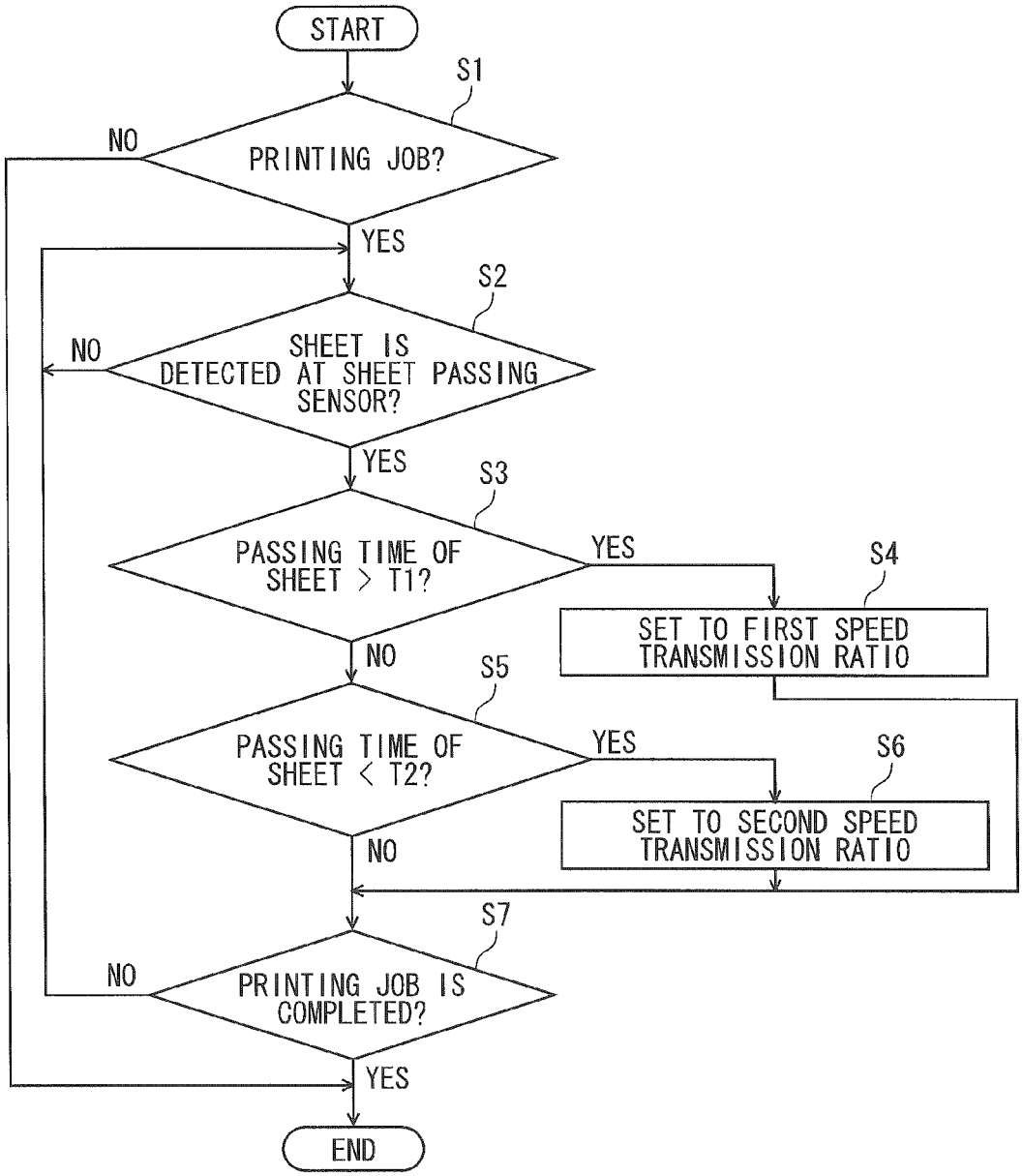
FIG. 7 is a flowchart showing operations of a control device according to the first example.

The control device 300 configured as described above executes the control in accordance with a flowchart shown in FIG. 7. Meanwhile, in this control, the speed transmission ratio of the transmission mechanism 200 when the user first operates the color printer 1 is regarded as the first speed transmission ratio, and the speed transmission ratio set upon completion of the previous control is maintained even when a next control starts.

As shown in FIG. 7, the control device 300 determines whether there is a printing job (S1). If it is determined in step S1 that there is no printing job (S1: No), the control device 300 ends the control. If it is determined that there is a printing job (S1: Yes), the control device 300 determines whether the sheet passing sensor 310 detects the passing of the sheet P (S2).

If it is determined in step S2 that the sheet passing sensor 310 does not detect the passing of the sheet P (S2: No), the control device 300 iterates the processing of step S2. If it is determined that the sheet passing sensor 310 detects the passing of the sheet P (S2: Yes), the control device 300 determines whether the passing time of the sheet P is greater than the first time T1 (S3). If it is determined that the passing time of the sheet P is greater than the first time T1 (S3: Yes), the control device 300 activates the electromagnetic clutch 221 of the connection mechanism 220 to thus make the connected state (the state shown in FIG. 6C), thereby setting the speed transmission ratio of the transmission mechanism 200 to the first speed transmission ratio (S4).

If it is determined in step S3 that the passing time of the sheet P is equal to or less than the first time T1 (S3: No), the control device 300 determines whether the passing time of the sheet P is less than the second time T2 (S5). If it is determined that the passing time of the sheet P is less than the second time T2 (S5: Yes), the control device 300 inactivates the electromagnetic clutch 221 of the connection mechanism 220 to thus make the disconnected state (the state shown in FIG. 6A), thereby setting the speed transmission ratio of the transmission mechanism 200 to the second speed transmission ratio (S6).

When any one speed transmission ratio is set in steps S4 and S6 or if it is determined in step S5 that the passing time of the sheet P is equal to or greater than the second time T2 (S5: No), the control device 300 determines whether the printing job is completed (S7). If it is determined that the printing job is not completed (S7: No), the control device 300 iterates the processing from step S2, and if it is determined that the printing job is completed (S7: Yes), the control device 300 ends the control.

The advantages of the control device 300 configured as described above are described.

When the user first operates the color printer 1 to execute the printing job, the control device 300 drives the pressing roller 150 with the first speed transmission ratio that is an initial setting. At this time, since the pressing roller 150 has not been heated to the inside thereof, the conveying speed of the sheet P in the fixing unit 100 is a predetermined speed.

The predetermined speed is equal to or less than the conveying speed of the sheet P on the photosensitive drums 51 and the conveyance belt 73.

After that, as the printing jobs are repeatedly performed, the inside of the pressing roller 150 is heated and thermally expanded. Thereby, when the diameter of the pressing roller 150 becomes larger than a diameter at the room temperature, the conveying speed of the sheet P in the fixing unit 100 becomes higher than a predetermined speed. For this reason, if the first speed transmission ratio is kept as it is, an amount of slackness of the sheet P between the image forming unit 30 and the fixing unit 100 is reduced.

However, according to this illustrative embodiment, when the passing time of the sheet P at the position of the sheet passing sensor 310 becomes less than the second time T2 less than the first time T1, the control device 300 sets the speed transmission ratio of the transmission device 200 to the second speed transmission ratio. Thereby, the rotating speed of the pressing roller 150 is reduced and the change in the conveying speed of the sheet P due to the thermal expansion of the pressing roller 150 can be absorbed, so that it is possible to prevent the slackness of the sheet P between the image forming unit 30 and the fixing unit 100 from being reduced.

Also, after the speed transmission ratio is set to the second speed transmission ratio, when the printing job is executed at the time that predetermined time elapses from the completion of the printing job and the diameter of the pressing roller 150 becomes substantially the same as the diameter at the room temperature, the conveying speed of the sheet P in the fixing unit 100 is reduced. For this reason, if the second speed transmission ratio is kept as it is, the amount of slackness of the sheet P between the image forming unit 30 and the fixing unit 100 is increased.

However, according to this illustrative embodiment, when the passing time of the sheet P at the position of the sheet passing sensor 310 becomes greater than the first time T1, the control device 300 sets the speed transmission ratio of the transmission device 200 to the first speed transmission ratio. Thereby, the rotating speed of the pressing roller 150 is increased, so that it is possible to prevent the slackness of the sheet P between the image forming unit 30 and the fixing unit 100 from being increased. By the control, it is possible to change the driving power to be transmitted to the fixing unit 100 in conformity to the state of the pressing roller 150 without changing the rotating speed of the motor M. For this reason, since it is possible to adjust the conveying speed of the sheet P in the fixing unit 100 without controlling the rotating speed of the motor M, it is possible to keep the amount of slackness of the sheet P being conveyed between the fixing unit 100 and the image forming unit 30 within a predetermined range.

When the connection mechanism 220 is at the disconnected state, the rotation of the sun gear 212 is regulated. Therefore, the sun gear 212 is applied with the force from the carrier 213 and is not thus rotated. For this reason, it is possible to stably transmit only the driving power from the ring gear 211 to the fixing unit 100.

Since it is possible to select the speed transmission ratio in accordance with the actual conveying speed by detecting the passing of the sheet P at the sheet passing sensor 310, it is possible to keep the amount of slackness of the sheet P between the image forming unit 30 and the fixing unit 100 within the predetermined range.

Since the motor M is also used to drive the image forming unit 30 or sheet conveyance mechanism 22, which is driven at the constant speed, it is possible to reduce a number of components, thereby reducing the cost.

Although the illustrative embodiment of the present invention has been described, the present invention is not limited to the illustrative embodiment. That is, the specific configurations can be appropriately changed without departing from the scope of the present invention.

Figure 8:
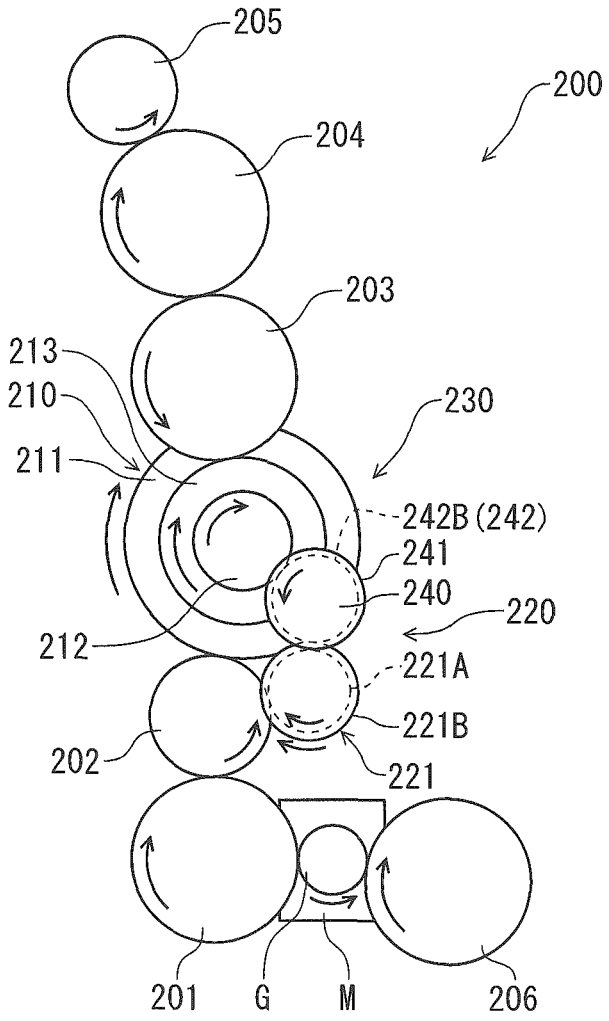
FIG. 8 illustrates an entire transmission mechanism according to a modified embodiment of the first example.
Figure 9A:
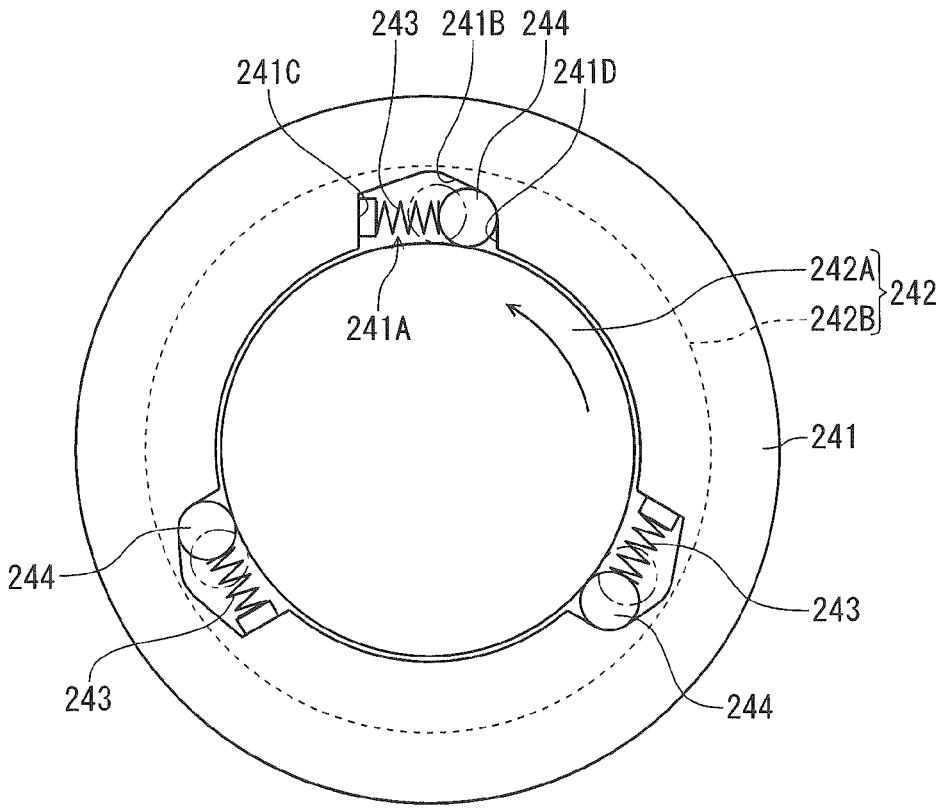
Figure 9B:
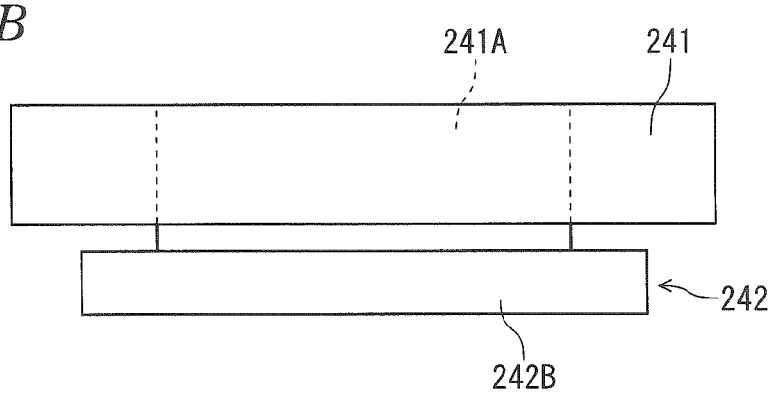

In the above illustrative embodiment, the swinging gear 231 and the engaging part 232 have been exemplified as the rotation restraint mechanism 230. However, for example, as shown in FIG. 8, a one-way clutch 240 may be used as the rotation restraint mechanism. In this configuration, the one-way clutch 240 is used instead of the connection gear 222, which is a part of the connection mechanism 220 in the above illustrative embodiment, and is provided with an outer ring 241, a connection gear 242, coil springs 243 and rollers 244, as shown in FIGS. 9A and 9B.

The outer ring 241 is provided with circular shape and is disposed so that an outer periphery thereof does not interfere with any gear. The outer ring 241 is fixed to an appropriate position of the apparatus main body 10 so that it cannot be rotated, and is provided on its inner periphery with concave portions 241A recessed outwardly. The concave portions 241A are portions in which the coil springs 243 and the rollers 244 are accommodated, and are provided by three at an equal interval on the inner periphery of the outer ring 241. The concave portion 241A is provided with an inclined surface 241B configured so that it is inclined towards an outer side as it faces towards a downstream side in a counterclockwise direction from an upstream-side end portion (hereinafter, referred to as upstream end) of a bottom surface in the counterclockwise direction.

The connection gear 242 is provided with an inner ring 242A positioned at an inner side of the outer ring 241 and a gear part 242B disposed to deviate from the inner ring 242A in a direction of the rotary shaft.

The inner ring 242A is configured to have a diameter slightly smaller than an inner periphery of the outer ring 241, and is rotatably disposed at the inner side of the outer ring 241 with a slight gap from the outer ring 241.

The gear part 242B is a gear configured to mesh with the output gear 221B of the electromagnetic clutch 221 and the sun gear 212, and is configured integrally with the inner ring 242A. The gear part 242B is provided with diameter smaller than the outer periphery of the outer ring 241 and smaller than the inner periphery thereof.

The coil spring 243 has one end fixed to a downstream side surface 241C of the concave portion 241A in the counterclockwise direction and the other end urging the roller 244 towards an upstream side surface 241D of the concave portion 241A in the counterclockwise direction.

The roller 244 is configured to move circumferentially between the inclined surface 241B and the inner ring 242A. When the roller is moved to an upstream end position of the inclined surface 241B at which an interval between the inclined surface 241B and the inner ring 242A is narrowest, the roller is sandwiched by the inclined surface 241B and the inner ring 242A. In this way, when the roller 244 is moved to the position at which it is sandwiched by the inclined surface 241B and the inner ring 242A, the outer ring 241 and the inner ring 242A are locked by the urging force of the coil spring 243.

The one-way clutch 240 operates as described below.

At the connected state, when the driving power of the motor M is input from the output gear 221B of the electromagnetic clutch 221 to the gear part 242B of the connection gear 242, the inner ring 242A of the connection gear 242 intends to rotate in the counterclockwise direction. Then, the rollers 244 are moved in a direction separating from the upstream ends of the inclined surfaces 241B and the upstream side surfaces 241D of the concave portions 241A (refer to the dashed-two dotted line in FIG. 9A). Thereby, the rollers 244 are not sandwiched by the inclined surfaces 241B and the inner rings 242A. That is, the lock between the outer ring 241 and the inner ring 242A is released and the outer ring 241 and the inner ring 242A can be relatively rotated. Therefore, the connection gear 242 is rotated in the counterclockwise direction. In this way, the driving power of the motor M is transmitted to the sun gear 212 through the electromagnetic clutch 221 and the one-way clutch 240.

Also, when the connected state is switched to the disconnected state, since the sun gear 212 intends to rotate in the counterclockwise direction by the planetary gears 213A (refer to FIG. 6D), the connection gear 242 intends to rotate in the clockwise direction. At this time, since the rollers 244 are sandwiched by the inclined surfaces 241B and the inner rings 242A and are restrained from moving in the clockwise direction, the lock state between the outer ring 241 and the inner ring 242A is kept. For this reason, the inner ring 242A is restrained from rotating in the clockwise direction by the fixed outer ring 241 and rollers 244, and the rotation of the sun gear 212 is also restrained. Therefore, even when the rotation restraint mechanism is the one-way clutch 240, it is possible to stop the sun gear 212.

Also, since the one-way clutch 240 is not rotated by the driving power from the sun gear 212 at the disconnected state, the output gear 221B of the electromagnetic clutch 221 configured to mesh with the connection gear 242 is not also rotated. That is, since the one-way clutch 240 does not transmit the driving power from the downstream towards the upstream, it is possible to prevent the output gear 221B from spinning freely.

The control device 300 of the first example is configured to execute the selection control based on the passing time of the sheet P at the position of the sheet passing sensor 310. However, the present invention is not limited to the configuration. For example, the sheet passing sensor 310 may be configured as a speed sensor configured to measure the conveying speed of the sheet P. In this case, when the input conveying speed of the sheet P in the fixing unit 100 is less than a conveying speed V1, which is an example of a first threshold, the control device 300 may select the first speed transmission ratio, and when the input conveying speed is greater than a conveying speed V2, which is an example of a second threshold, the control device 300 may select the second speed transmission ratio. In the meantime, the conveying speed V1 and the conveying speed V2 are not necessarily changed depending on the size of the sheet P and can be appropriately set by a test, a simulation and the like.

The control device 300 of the first example is configured to execute the selection control by using the detection signal of the sheet passing sensor 310. However, the present invention is not limited to the configuration. For example, the control device 300 may be configured to execute the selection control based on a number of printed sheets during a predetermined time period. When the number of printed sheets during the predetermined time period increases, the diameter of the pressing roller 150 is changed, so that the conveying speed of the sheet P in the fixing unit 100 is changed. However, according to the above configuration, since the control device 300 is configured to execute the selection control based on the number of printed sheets during the predetermined time period, it is possible to keep the amount of slackness of the sheet P being conveyed between the fixing unit 100 and the image forming unit 30 within the predetermined range.

In the above configuration, the control device 300 is provided with a counter configured to count a number of printed sheets within a predetermined time period before the final printing has been performed. When the number of printed sheets is less than a predetermined number of sheets, which is an example of a fifth threshold, the control device 300 selects the first speed transmission ratio, and when the number of printed sheets is greater than the predetermined of sheets, the control device 300 selects the second speed transmission ratio. Also, the control device 300 is configured to record printing time after one sheet is printed. The number of printed sheets within the predetermined time period is determined by counting the printing time recorded within the predetermined time period. In the meantime, the predetermined time period and the predetermined number of sheets can be appropriately set by a test or a simulation.

Figure 10:
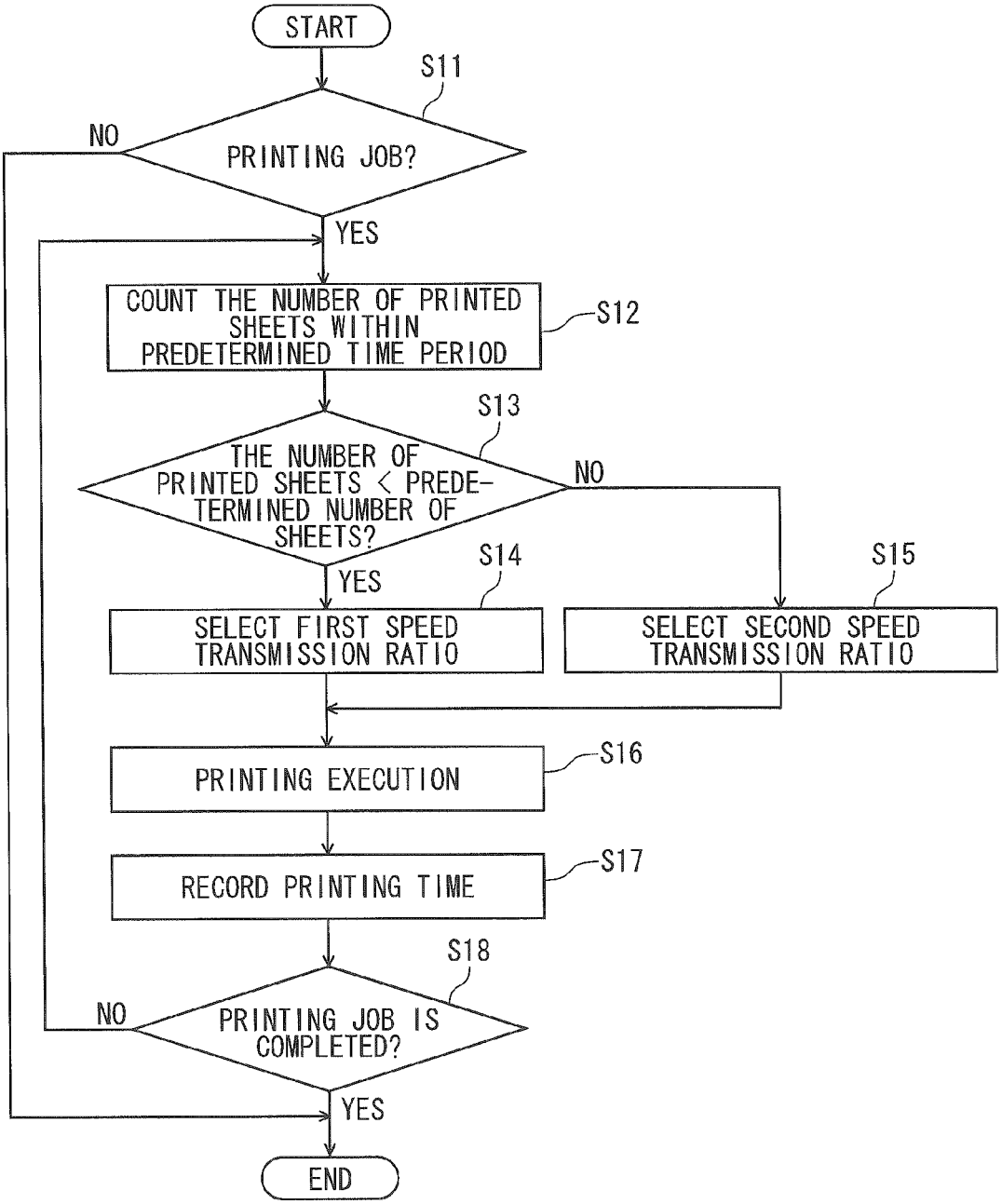
FIG. 10 is a flowchart showing a first modified embodiment of the operations of the control device.

The control device 300 configured as described above executes the control in accordance with a flowchart shown in FIG. 10. As shown in FIG. 10, the control device 300 determines whether there is a printing job (S11). If it is determined in step S11 that there is no printing job (S11: No), the control device 300 ends the control. If it is determined that there is a printing job (S11: Yes), the control device 300 counts a number of printed sheets (a plurality of times corresponding to the number of printed sheets) within a predetermined time period before the final printing has been performed (S12) and determines whether the number of printed sheets is less than the predetermined number of sheets (S13).

If it is determined in step S13 that the number of printed sheets is less than the predetermined number of sheets (S13: Yes), the control device 300 selects the first speed transmission ratio (S14), and when the number of printed sheets is equal to or greater than the predetermined number of sheets (S13: No), the control device 300 selects the second speed transmission ratio (S15).

After step S14 or step S15, the control device 300 executes the printing control for one sheet (S16) and records the execution time (S17). Then, the control device 300 determines whether the printing job is completed (S18). When the printing job is not completed (S18: No), the control device 300 repeats the processing from step S12. When the printing job is completed (S18: Yes), the control device 300 ends the control.

Also, the counter may be configured to count a number of rotations of the motor M within the predetermined time period before the final printing has been performed. When the number of rotations of the motor M within the predetermined time period increases, the diameter of the pressing roller 150 is changed and the conveying speed of the sheet P in the fixing unit 100 is thus changed. However, according to the above configuration, since the control device 300 executes the selection control based on the number of rotations of the motor M within the predetermined time period, it is possible to keep the amount of slackness of the sheet P being conveyed between the fixing unit 100 and the image forming unit 30 within the predetermined range.

In the above configuration, when the number of rotations is less than a predetermined number of times, which is an example of a sixth threshold, the control device 300 selects the first speed transmission ratio, and when the number of rotations is equal to or greater than the predetermined number of times, the control device 300 selects the second speed transmission ratio. Also, like the example shown in FIG. 10, after the printing is performed for one sheet, the control device 300 records the printing time. The number of rotations of the motor M within the predetermined time period is determined by a product of the number of rotations of the motor M considered necessary for the printing of one sheet and the number of printed sheets within the predetermined time period. In the meantime, the predetermined time period and the predetermined number of times can be appropriately set by a test, a simulation and the like.

Figure 11:
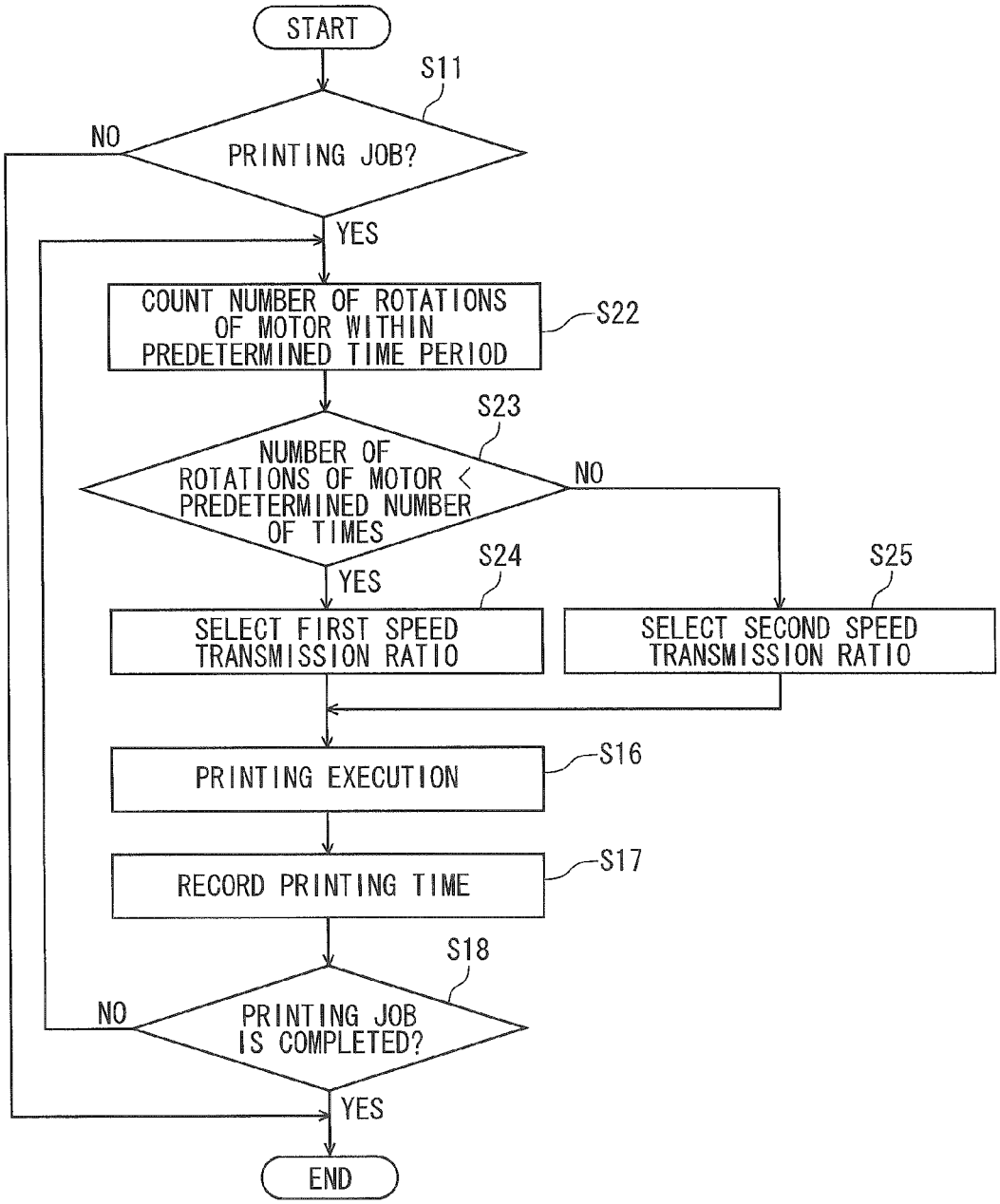
FIG. 11 is a flowchart showing a second modified embodiment of the operations of the control device.

The control device 300 configured as described above executes the control in accordance with a flowchart shown in FIG. 11. As shown in FIG. 11, the processing of step S11 is the same as FIG. 10, and if it is determined that there is a printing job (S11: Yes), the control device 300 counts a number of rotations with the predetermined time period before the final printing has been performed (S22) and determines whether the number of rotations is less than the predetermined number of times (S23).

If it is determined in step S23 that the number of rotations is less than the predetermined number of times (S23: Yes), the control device 300 selects the first speed transmission ratio (S24). If it is determined that the number of rotations is equal to or greater than the predetermined number of times (S23: No), the control device 300 selects the second speed transmission ratio (S25). After step S24 or S25, the processing of step S16 and thereafter is the same as FIG. 10.

In the above illustrative embodiment, the ring gear 211 is an example of the first element, the sun gear 212 is an example of the second element and the carrier 213 is an example of the third element. However, the present invention is not limited thereto and can be appropriately changed in accordance with the illustrative embodiments. For example, even when the sun gear 212 is adopted as the first element and the ring gear 211 is adopted as the second element, it is possible to increase the speed transmission ratio of the transmission device 200, like the above illustrative embodiment.

In the above illustrative embodiment, the connection mechanism 220 includes the electromagnetic clutch 221. However, the present invention is not limited thereto and the configuration of the connection mechanism 220 can be appropriately changed. For example, the swinging gear 231 may be moved using a solenoid, so that the connection mechanism 220 can be switched between the connected state and the disconnected state.

In the above illustrative embodiment, the configuration having the fixing belt 110 has been exemplified as the heating unit. However, the present invention is not limited thereto, and a heating roller may be used as the heating unit. Also, when the heating roller is used, the heating roller may be input with the driving power of the motor M. Also, the pressing roller may be urged towards the heating roller by the urging member.

In the above illustrative embodiment, the driving power of the motor M is also transmitted to the sheet conveyance mechanism 22 and the photosensitive drums 51. However, the present invention is not limited thereto. For example, the driving power may be transmitted only to the fixing unit 100.

In the above illustrative embodiment, the sheet passing sensor 310 is disposed at the position adjacent to the downstream side of the fixing unit 100. However, the sheet passing sensor 310 may be disposed at a position adjacent to the upstream side of the fixing unit 100.

Subsequently, a configuration of a transmission device 500 according to a second example is described in detail. The transmission device 500 is another illustrative embodiment of the transmission device 200 according to the first example in the color printer 1 of the illustrative embodiment.

Figure 12:
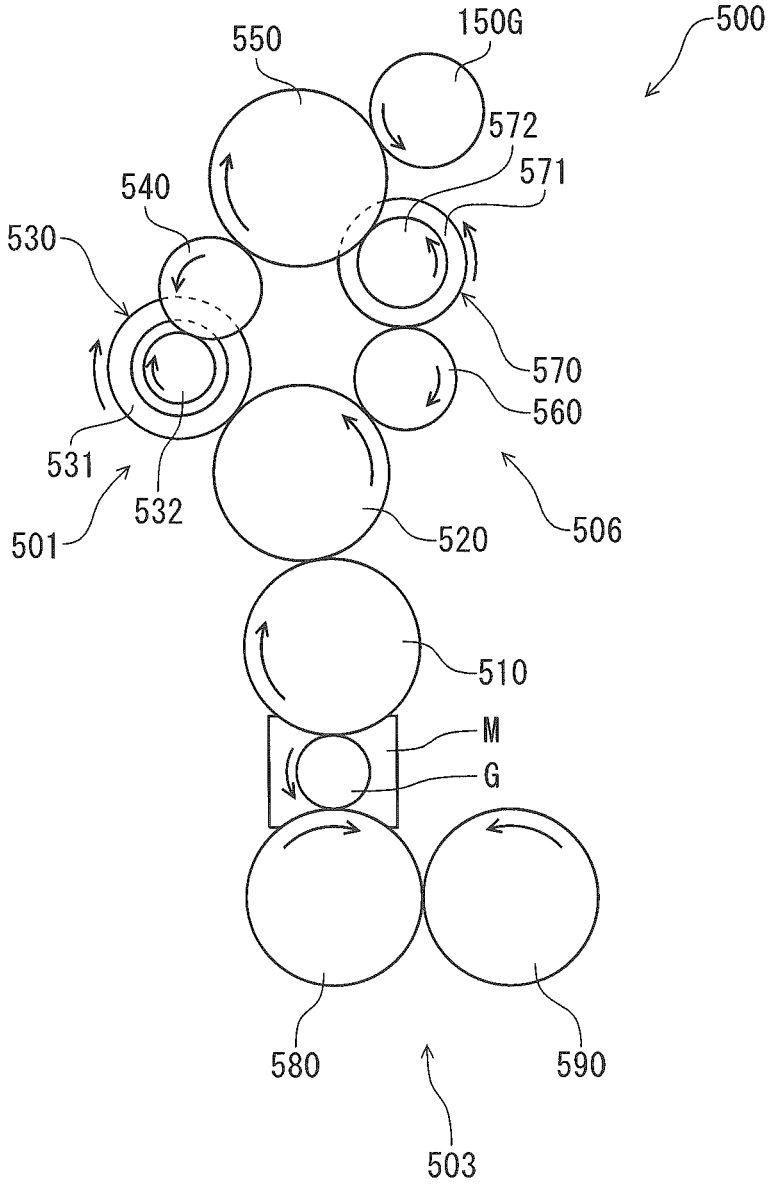
FIG. 12 illustrates a state where a first mode is selected in a transmission mechanism according to a second example.

As shown in FIG. 12, the transmission device 500 is a mechanism for transmitting the driving power of the motor M to the pressing roller 150 of the fixing unit 100. As shown in FIG. 12, the transmission device 500 is provided with first drive train 501 of which speed transmission ratio is a first value and a second drive train 502 of which speed transmission ratio is a second value greater than the first value, and is configured to transmit the driving power of the motor M to the pressing roller 150 through one of the first drive train 501 and the second drive train 502. Meanwhile, in FIG. 12, each gear is shown with a pitch circle.

The speed transmission ratio is a value obtained by an angular velocity of an input gear/an angular velocity of an output gear, i.e., an angular velocity of a first transmission gear 510/an angular velocity of a pressing roller gear 150G.

The first drive train 501 is provided with first transmission gear 510 configured to mesh with a driving gear G configured to rotate integrally with the rotary shaft of the motor M, a first intermediate gear 520 configured to mesh with the first transmission gear 510, an electromagnetic clutch 530 configured to mesh with the first intermediate gear 520, a second intermediate gear 540 configured to mesh with the electromagnetic clutch 530, a first driving input gear 550 configured to mesh with the second intermediate gear 540 and a pressing roller gear 150G configured to mesh with the first driving input gear 550 and to rotate integrally with the pressing roller 150.

The second drive train 502 is provided with third intermediate gear 560 configured to mesh with the first intermediate gear 520 and a one-way clutch 570 configured to mesh with the third intermediate gear 560 and the first driving input gear 550, in addition to the first transmission gear 510, the first intermediate gear 520, the first driving input gear 550 and the pressing roller gear 150G.

In the meantime, the motor M is also connected with a third drive train 503 for transmitting the driving power of the motor M to the respective photosensitive drums 51 and the sheet conveyance mechanism 22.

The third drive train 503 mainly is provided with second transmission gear 580 configured to mesh with the driving gear G and a second driving input gear 590 configured to mesh with the second transmission gear 580. The second driving input gear 590 is connected to the respective photosensitive drums 51 and the respective rollers of the sheet conveyance mechanism 22 via a plurality of gears and the like (not shown). That is, in this illustrative embodiment, the driving power of the motor M is also transmitted to the respective photosensitive drums 51 and the sheet conveyance mechanism 22.

In the meantime, the third drive train 503 may be also configured to transmit the driving power of the motor M not only to the respective photosensitive drums 51 and the sheet conveyance mechanism 22 but also to the other sheet conveyance units for conveying the sheet P such as the respective rollers (the driving roller 71 and the transfer rollers 74) of the transfer unit 70, the conveyance rollers 91 of the sheet discharge unit 90, and the like.

The electromagnetic clutch 530 is an example of a connection mechanism capable of selecting a connected state where the driving power of the motor M can be transmitted to the pressing roller gear 150G through the first drive train 501 and a disconnected state where the driving power of the motor M cannot be transmitted to the pressing roller gear 150G through the first drive train 501.

Figure 13A:
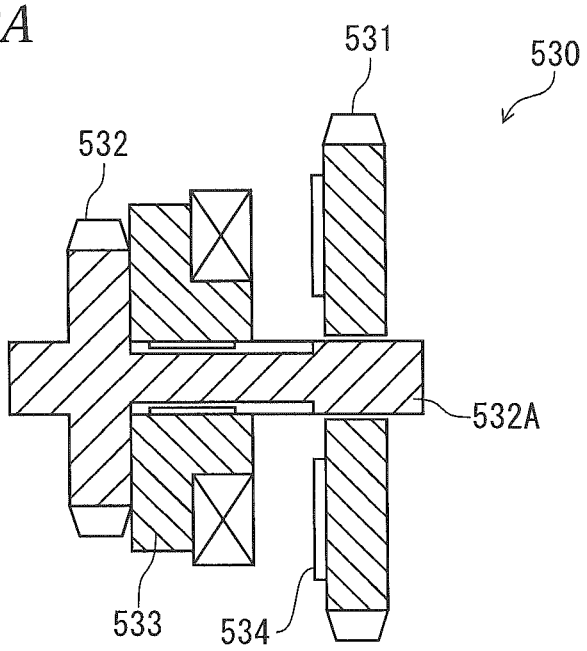

As shown in FIG. 13A, the electromagnetic clutch 530 is provided with an input gear 531, which is an example of an input part configured to mesh with the first intermediate gear 520, an output gear 532, which is an example of an output part configured to mesh with the second intermediate gear 540, a moving core 533 and a fixed core 534. The electromagnetic clutch 530 is configured to select the connected state where the input gear 531 and the output gear 532 are rotated together and the disconnected state where the output gear 532 is not rotated.

The output gear 532 is provided with rotary shaft 532A, and the input gear 531 is rotatably mounted to the rotary shaft 532A via a bearing (not shown).

The moving core 533 is disposed between the input gear 531 and the output gear 532 and is wound with coils. The moving core 533 is engaged with the rotary shaft 532A of the output gear 532 via a spline or serration, and is configured to be axially movable with respect to the rotary shaft 532A and to be rotatable integrally with the rotary shaft 532A. Also, the moving core 533 is urged towards a direction separating from the input gear 531 by an urging member (not shown).

Figure 13B:
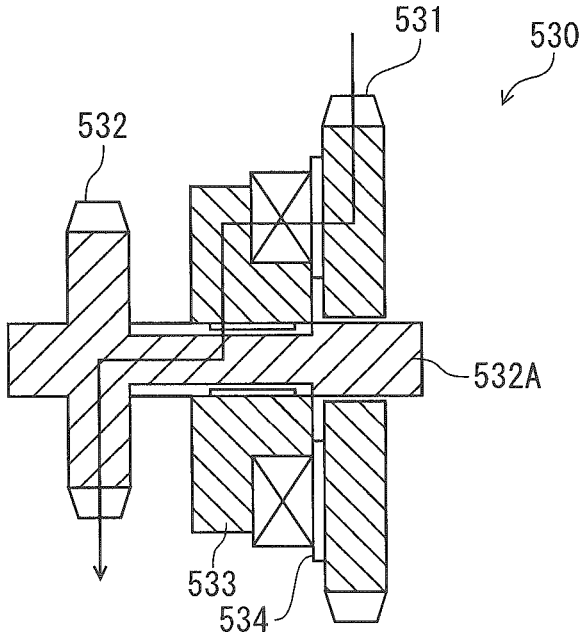

The fixed core 534 is fixed to an end face of the input gear 531 facing the moving core 533. For this reason, when the moving core 533 is activated, the moving core 533 is moved towards the input gear 531 by an electromagnetic suction force and is sucked to the fixed core 534, as shown in FIG. 13B. Thereby, the moving core 533 and the input gear 531 are integrated and the electromagnetic clutch 530 is at the connected state where the input gear 531 and the output gear 532 are integrally rotated, so that the driving power transmitted to the input gear 531 from the motor M is transmitted to the second intermediate gear 540.

Also, when the moving core 533 is not activated, the moving core 533 and the fixed core 534 are not sucked and the electromagnetic clutch 530 is at the disconnected state where the input gear 531 and the output gear 532 are not rotated integrally, as shown in FIG. 13A, so that the driving power transmitted to the input gear 531 from the motor M is not transmitted to the second intermediate gear 540.

As shown in FIG. 12, the one-way clutch 570 is configured to rotate only in one direction for transmitting the driving power of the motor M to the pressing roller gear 150G and not to rotate by the driving power from the pressing roller gear 150G. Specifically, as shown in FIG. 14A, the one-way clutch 570 is provided with circular outer ring 571, an inner ring 572 of which a part is disposed at an inner side of the outer ring 571, a plurality of rollers 573 disposed between the outer ring 571 and the inner ring 572, and urging members 574 provided in correspondence to the respective rollers 573.

The outer ring 571 is provided on its outer periphery with gear teeth (not shown) and is configured to mesh with the third intermediate gear 560. The outer ring 571 is formed at a plurality of places on an inner periphery thereof with pockets 571A recessed outwardly. A bottom of the pocket 571A is inclined outwardly from a central portion in a rotating direction of the outer ring 571 so that it comes closer to the inner ring 572.

Figure 14A:
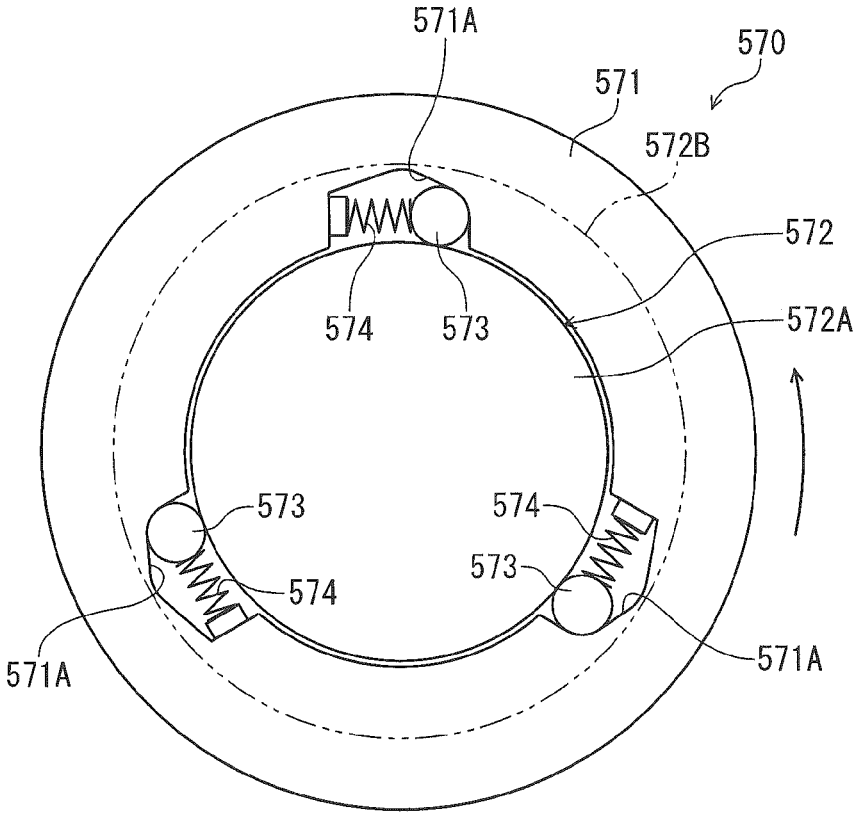
Figure 14B:
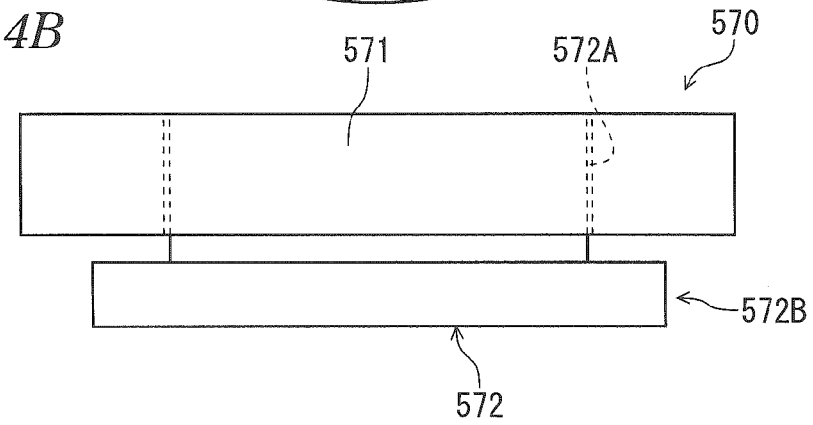

As shown in FIG. 14B, the inner ring 572 is provided with an inner part 572A disposed at an inner side of the outer ring 571 and a gear part 572B disposed at an axially deviating position with respect to the outer ring 571 and configured to rotate integrally with the inner part 572A. The gear part 572B is provided on its outer periphery with gear teeth (not shown) and is configured to mesh with the first driving input gear 550.

As shown in FIG. 14A, each roller 573 is disposed in the pocket 571A of the outer ring 571. The roller 573 is urged towards an upstream end portion of the pocket 571A in a rotating direction (the counterclockwise direction in FIG. 14A) of the outer ring 571 by the urging member 574.

In the one-way clutch 570 configured as described above, when the outer ring 571 is rotated relative to the inner ring 572 in the counterclockwise direction in FIG. 14A, the rollers 573 are fitted between the bottoms of the pockets 571A and the inner ring 572, so that the outer ring 571 and the inner ring 572 are meshed. At this time, the inner ring 572 is rotated together with the outer ring 571 in the counterclockwise direction. On the other hand, when the inner ring 572 is rotated relative to the outer ring 571 in the counterclockwise direction, the rollers 573 are moved towards the downstream side with respect to the rotating direction by a frictional force between the rollers 573 and the inner ring 572, so that the meshed state between the inner ring 572 and the outer ring 571 is released. At this time, the inner ring 572 and the outer ring 571 are individually rotated.

As shown in FIG. 12, for the electromagnetic clutch 530 and the second intermediate gear 540 configuring the first drive train 501 and the third intermediate gear 560 and the one-way clutch 570 configuring the second drive train 502, the number of teeth is respectively set so that the speed transmission ratio of the second drive train 502 becomes a second value greater than the first value, which is the speed transmission ratio of the first drive train 501.

Thereby, the angular velocity of the first driving input gear 550 when the driving power of the motor M is transmitted via the electromagnetic clutch 530 and the second intermediate gear 540 is greater than the angular velocity of the first driving input gear 550 when the driving power of the motor M is transmitted via the third intermediate gear 560 and the one-way clutch 570.

In this way, the transmission device 500 is configured so that the switching of the connected state and disconnected state of the electromagnetic clutch 530 is controlled by the control device 300 (refer to FIG. 1) and the driving power of the motor M can be transmitted to the pressing roller 150 of the fixing unit 100 through one of the first drive train 501 and the second drive train 502.

The operations of the transmission device 500 that are performed when the electromagnetic clutch 530 is at the connected state and when the electromagnetic clutch 530 is at the disconnected state are described.

As shown in FIG. 12, when the motor M is driven at the connected state of the electromagnetic clutch 530, the respective gears configuring the first drive train 501 are rotated, so that the driving power of the motor M is transmitted to the pressing roller gear 150G through the first drive train 501 and the pressing roller 150 is thus rotated at a first speed.

At this time, the driving power of the motor M is also transmitted to the outer ring 571 of the one-way clutch 570 of the second drive train 502. At this time, since the angular velocity of the first driving input gear 550 when the driving power of the motor M is transmitted via the electromagnetic clutch 530 and the second intermediate gear 540 is greater than the angular velocity of the first driving input gear 550 when the driving power of the motor M is transmitted via the third intermediate gear 560 and the one-way clutch 570, the inner ring 572 of the one-way clutch 570 is applied with the driving power from the first driving input gear 550 and is thus rotated, so that the angular velocity of the inner ring 572 becomes greater than the angular velocity of the outer ring 571. Thereby, the meshed state between the outer ring 571 and the inner ring 572 of the one-way clutch 570 is released, so that the outer ring 571 freely spins around the inner ring 572. For this reason, the driving power of the motor M is not transmitted to the pressing roller gear 150G via the second drive train 502.

Figure 15:
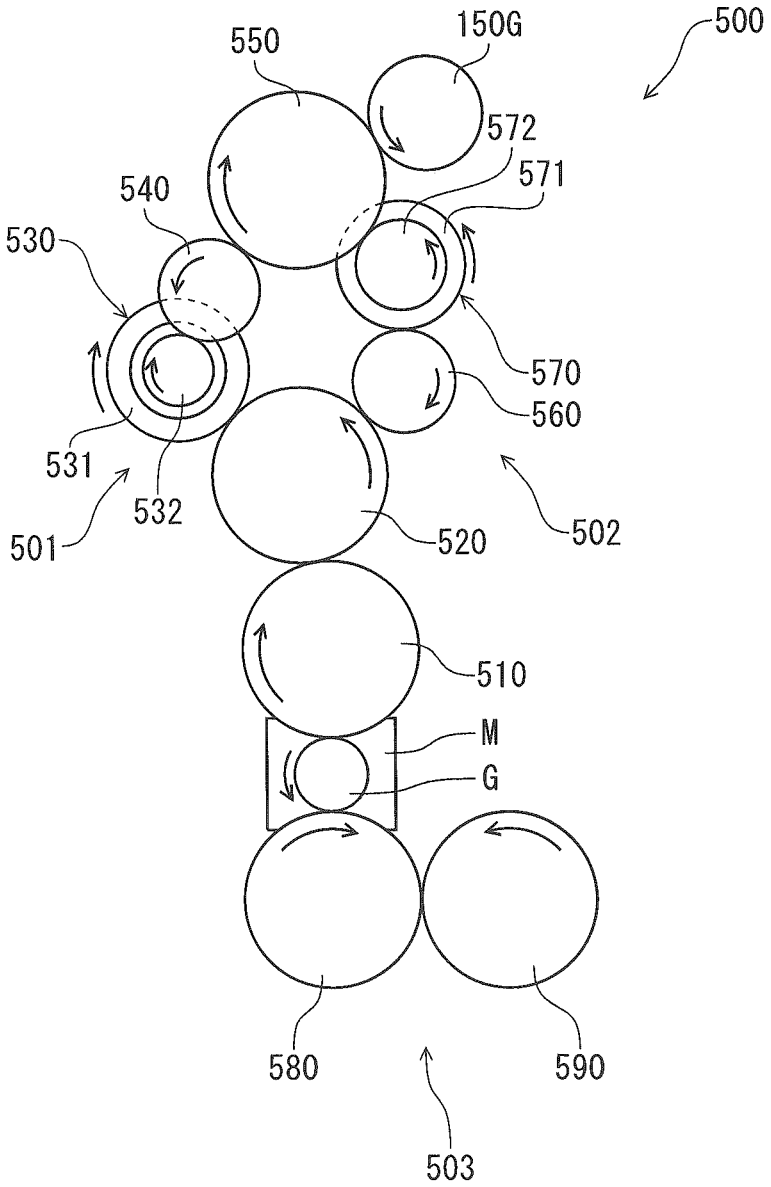
FIG. 15 illustrates a state where a second mode is selected in the transmission mechanism according to the second example.

As shown in FIG. 15, when the motor M is driven at the disconnected state of the electromagnetic clutch 530, the driving power of the motor M is transmitted to the input gear 531 of the electromagnetic clutch 530 but is not transmitted to the output gear 532. Thereby, the driving power of the motor M is not transmitted to the pressing roller gear 150G from the first drive train 501. On the other hand, since the respective gears configuring the second drive train 502 are rotated and the outer ring 571 and inner ring 572 of the one-way clutch 570 are meshed, the driving power of the motor M is transmitted to the pressing roller gear 150G through the second drive train 502, so that the pressing roller 150 is rotated at a second speed less than the first speed. In the meantime, although the output gear 532 of the electromagnetic clutch 530 is applied with the driving power from the first driving input gear 550 and is thus rotated, the output gear 532 freely spins with respect to the input gear 531.

Subsequently, an example of the control operation of the control device 300 for the transmission device 500 of the second example is described in detail.

The control device 300 is configured to execute a selection control of selecting any one of a first mode in which the driving power of the motor M is transmitted to the fixing unit 100 through the first drive train 501 by using the detection result of the sheet passing sensor 310 and a second mode in which the driving power of the motor M is transmitted to the fixing unit 100 through the second drive train 502 by using the detection result of the sheet passing sensor 310.

Specifically, the control device 300 sets the electromagnetic clutch 530 to the connected state and selects the first mode when the time period during which the sheet P having a predetermined length passes through the sheet passing sensor 310 is greater than the first time T1, which is an example of the third threshold, and sets the electromagnetic clutch 530 to the disconnected state and selects the second mode when the time period during which the sheet P having a predetermined length passes through the sheet passing sensor 310 is less than the second time T2, which is an example of the fourth threshold. Also, when the time period during which the sheet P having a predetermined length passes through the sheet passing sensor 310 is equal to or greater than the first time T1 and equal to or less than the second time T2, the control device 300 keeps the currently selected mode, as it is.

In this way, the control device 300 can perform the control in accordance with the conveying speed of the sheet P in the fixing unit 100, by selecting the first or second mode based on the time period during which the sheet P passes through the sheet passing sensor 310. That is, when the time period during which the sheet P passes through the sheet passing sensor 310 is longer than the first time T1, it corresponds to a case where the conveying speed of the sheet P in the fixing unit 100 is less than the first threshold. Also, when the time period during which the sheet P passes through the sheet passing sensor 310 is shorter than the second time T2, it corresponds to a case where the conveying speed of the sheet P in the fixing unit 100 is greater than the second threshold.

In this example, the first time T1 is set to be greater than the second time T2. However, the first time T1 and the second time T2 may be set to be the same. Also, the first time T1 and the second time T2 can be appropriately changed depending on the size of the sheet P and can be appropriately set by a user's input of the size of the sheet P, and the like. Also, the first time T1 and the second time T2 may be set based on the time period during which the sheet passes through the second sheet passing sensor 312 disposed at the upstream side of the sheet passing sensor 310 with respect to the conveyance path. At this time, the second sheet passing sensor 312 may be disposed between the sheet conveyance mechanism 22 and the image forming unit 30.

The control device 300 executes the selection control when the fixing unit 100 does not convey the sheet P. Specifically, for example, the control device 300 executes the selection control after the sheet passing sensor 310 disposed at the downstream side of the fixing unit 100 detects the passing time of the sheet P until a next sheet P is conveyed. Thereby, since the conveying speed is not varied upon the fixing of the sheet P, it is possible to stabilize the fixing operation.

Also, when performing a first printing after the power is input, the control device 300 selects the first mode. Also, when a printing job is input and a first sheet is printed, the control device 300 executes the finally selected mode in the previous printing job.

Figure 16:
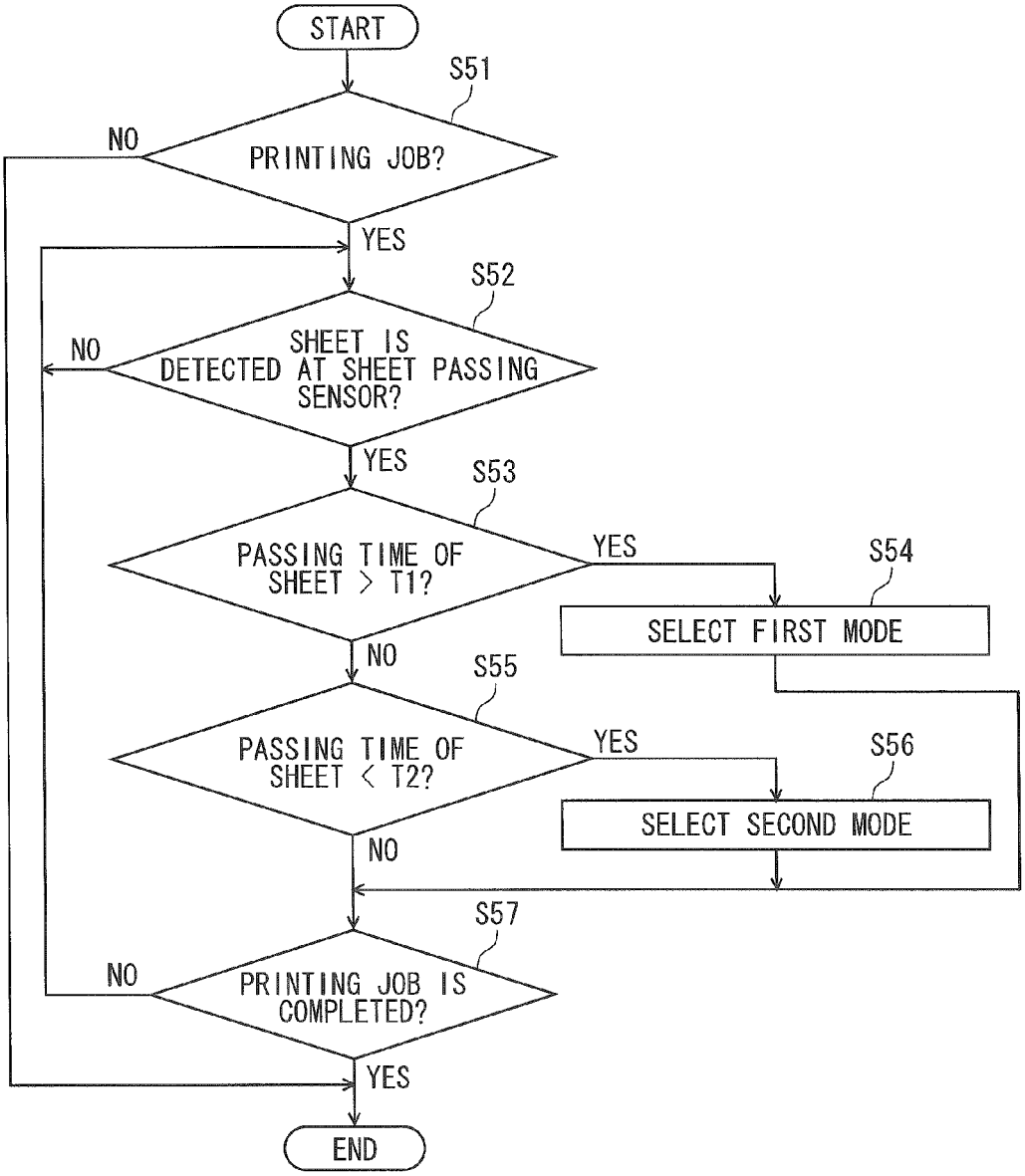
FIG. 16 is a flowchart showing operations of a control device according to the second example.

The operations of the control device 300 are described with reference to FIG. 16.

When the control operation starts, the control device 300 determines whether a printing job is received (S51). At this time, if it is determined that a printing job is not received (S51, No), the control device 300 ends the control operation. On the other hand, if it is determined that a printing job is received (S51, Yes), the control device 300 determines whether the sheet passing sensor 310 detects the passing of the sheet P (S52).

If it is determined in step S52 that the passing of the sheet P is not detected (S52, No), the control device 300 stands by until the sheet P is detected.

If it is determined in step S52 that the passing of the sheet P is detected (S52, Yes), the control device 300 determines whether the time period during which the sheet P passes through the sheet passing sensor 310 is longer than the first time T1 (S53). At this time, if it is determined that the time period during which the sheet P passes through the sheet passing sensor 310 is longer than the first time T1 (S53, Yes), the control device 300 sets the electromagnetic clutch 530 to the connected state and selects the first mode (S54).

On the other hand, if it is determined in step S53 that the time period during which the sheet P passes through the sheet passing sensor 310 is equal to or less than the first time T1 (S53, No), the control device 300 determines whether the time period during which the sheet P passes through the sheet passing sensor 310 is shorter than the second time T2 (S55). At this time, if it is determined that the time period during which the sheet P passes through the sheet passing sensor 310 is shorter than the second time T2 (S55, Yes), the control device 300 sets the electromagnetic clutch 530 to the disconnected state and selects the second mode (S56).

If it is determined in step S55 that the time period during which the sheet P passes through the sheet passing sensor 310 is equal to or greater than the second time T2 (S55, No), i.e., if it is determined that the time period during which the sheet P passes through the sheet passing sensor 310 is equal to or greater than the second time T2 and equal to or less than the first time T1, the control device 300 keeps the currently selected mode.

After selecting the mode, the control device 300 prints one sheet at the selected mode and determines whether the printing job is completed (S57). At this time, if it is determined that the printing job is completed (S57, Yes), the control device 300 stores the current mode and ends the control operation. On the other hand, if it is determined in step S57 that the printing job is not completed (S57, No), the control device 300 returns to step S52 and continues the control operation.

The operations and advantages of the color printer 1 configured as described above are described.

When the power is input and the printing job is first received, the color printer 1 performs the printing control at the first mode by the control device 300.

In the first mode, the electromagnetic clutch 530 is at the connected state. Therefore, as shown in FIG. 12, as the motor M is driven, the respective gears configuring the first drive train 501 are rotated, so that the driving power of the motor M is transmitted to the pressing roller 150 through the first drive train 501. Thereby, the sheet P is conveyed at the predetermined speed in the fixing unit 100.

Then, when the printing is continuously performed for the plurality of sheets, the respective members in the fixing unit 100 are heated by the radiation heat from the halogen lamp 120. At this time, since the pressing roller 150 is expanded, the peripheral speed thereof increases, as compared at the time that the pressing roller 150 has gotten cool, and the conveying speed of the fixing unit 100 becomes faster than the predetermined speed.

When the conveying speed of the sheet P in the fixing unit 100 increases, the time period during which the sheet P passes through the sheet passing sensor 310 becomes shorter than the second time T2. At this time, the printing control is performed at the second mode by the control device 300.

When the second mode is selected, the electromagnetic clutch 530 is at the disconnected state, as shown in FIG. 15. Therefore, the driving power of the motor M is transmitted to the pressing roller 150 through the second drive train 502. Thereby, the angular velocity of the pressing roller 150 is reduced, as compared at the first mode, and the peripheral speed of the expanded pressing roller 150 is prevented from excessively increasing. Therefore, it is possible to bring the conveying speed of the fixing unit 100 close to the predetermined speed.

When there is sufficient time after the printing job is over until a next job is input, the pressing roller 150 has gotten cool, so that the diameter of the pressing roller 150 becomes smaller than upon the expansion thereof. At this time, when the printing is again performed, the peripheral speed of the pressing roller 150 is reduced, as compared at the time that the previous printing job is over, and the conveying speed of the sheet P in the fixing unit 100 becomes slower than the predetermined speed. Thereby, since the time period during which the sheet P passes through the sheet passing sensor 310 becomes longer than the first time T1, the printing control is performed at the first mode by the control device 300. Thereby, the angular velocity of the pressing roller 150 becomes faster at the second mode, and the peripheral speed of the pressing roller 150 is prevented from being excessively reduced. Therefore, it is possible to set the conveying speed of the fixing unit 100 to the predetermined speed.

As described above, the color printer 1 having the transmission device 500 of the second example can change the conveying speed of the fixing unit 100 without changing the rotating speed of the motor M. Thereby, it is possible to keep the slackness of the sheet P between the image forming unit 30 and the fixing unit 100 within the predetermined range.

Since the rotating speed of the motor M is not changed, it is possible to constantly keep the conveying speed of the sheet P on the photosensitive drums 51 and the sheet conveyance mechanism 22.

In the above example, the first drive train 501 has the electromagnetic clutch 530 and the second drive train 502 has the one-way clutch 570. However, the present invention is not limited to the configuration.

Figure 17A:
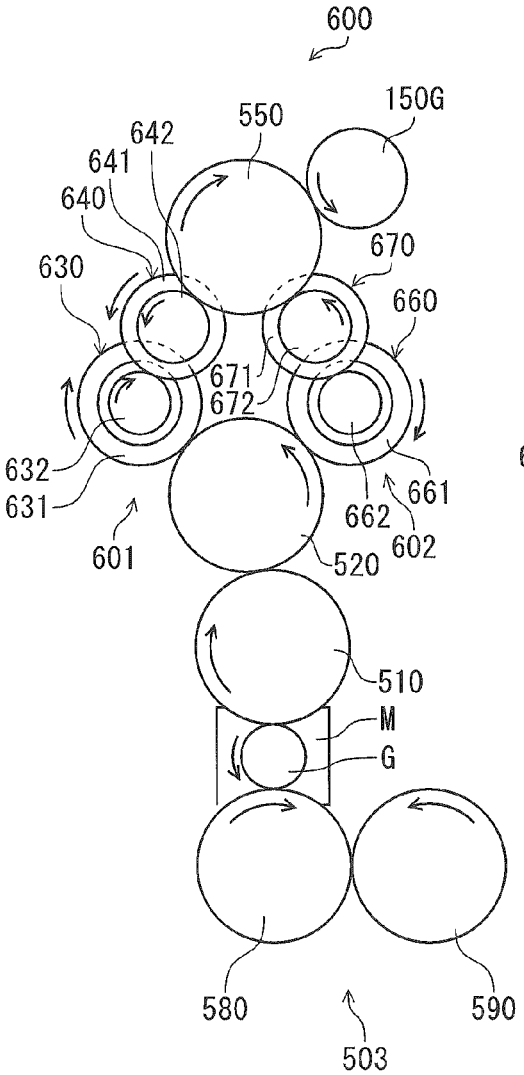
Figure 17B:
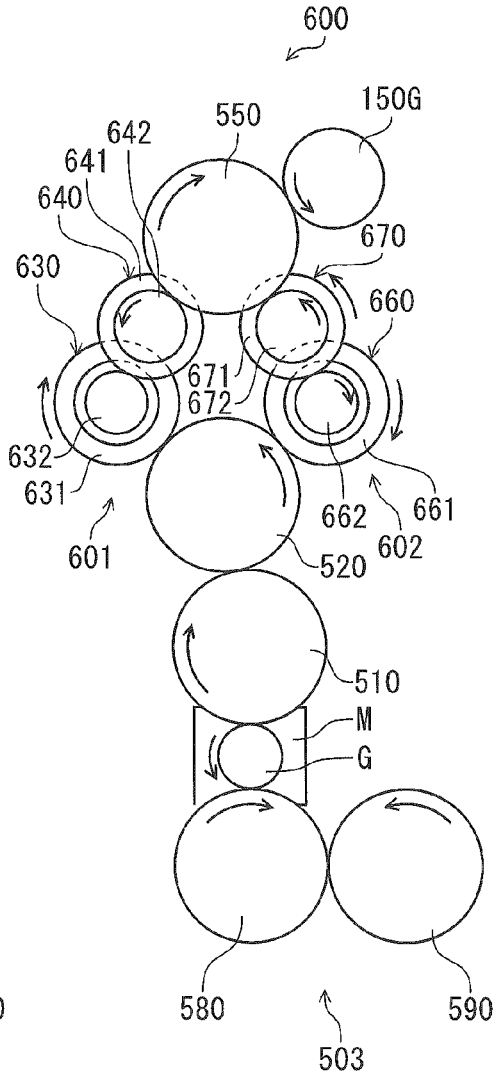

In the below, a transmission device 600 is described as a modified embodiment of the transmission device 500 of the second example. For example, as shown in FIGS. 17A and 17B, the transmission device 600 is provided with first drive train 601 and a second drive train 602 corresponding to the first drive train 501 and the second drive train 502 of the transmission device 500, and the first drive train 601 and the second drive train 602 are provided with electromagnetic clutches 630, 660 and one-way clutches 640, 670, respectively.

The first drive train 601 has the first transmission gear 510, the first intermediate gear 520, the first driving input gear 550 and the pressing roller gear 150G, like the transmission device 500 of the second example, and further has the first electromagnetic clutch 630 and the first one-way clutch 640, as an example of a first connection mechanism. Also, the second drive train 602 has the first transmission gear 510, the first intermediate gear 520, the first driving input gear 550 and the pressing roller gear 150G, like the transmission device 500 of the second example, and further has the second electromagnetic clutch 660 and the second one-way clutch 670, as an example of a second connection mechanism.

The first electromagnetic clutch 630 and the second electromagnetic clutch 660 have substantially the same configurations as the electromagnetic clutch 530 of the above illustrative embodiment, and an input gear 631 of the first electromagnetic clutch 630 and an input gear 661 of the second electromagnetic clutch 660 are respectively configured to mesh with the first intermediate gear 520.

The first one-way clutch 640 and the second one-way clutch 670 have substantially the same configurations as the one-way clutch 570 of the above illustrative embodiment, and an outer ring 641 of the first one-way clutch 640 is configured to mesh with an output gear 632 of the first electromagnetic clutch 630 and an inner ring 642 of the first one-way clutch 640 is configured to mesh with the first driving input gear 550. An outer ring 671 of the second one-way clutch 670 is configured to mesh with an output gear 662 of the second electromagnetic clutch 660, and an inner ring 672 of the second one-way clutch 670 is configured to mesh with the first driving input gear 550. That is, the first one-way clutch 640 is disposed between the first electromagnetic clutch 630 and the pressing roller gear 150G, and the second one-way clutch 670 is disposed between the second electromagnetic clutch 660 and the pressing roller gear 150G.

For the first electromagnetic clutch 630 and the first one-way clutch 640 and the second electromagnetic clutch 660 and the second one-way clutch 670, the number of teeth thereof is set so that the speed transmission ratio of the second drive train 602 becomes the second value greater than the first value, which is the speed transmission ratio of the first drive train 601.

The control device 300 is configured to set the first electromagnetic clutch 630 to the connected state and the second electromagnetic clutch 660 to the disconnected state at the first mode and to set the first electromagnetic clutch 630 to the disconnected state and the second electromagnetic clutch 660 to the connected state at the second mode.

In the transmission device 600 configured as described above, when the first mode is selected, the first electromagnetic clutch 630 is at the connected state and the second electromagnetic clutch 660 is at the disconnected state.

Therefore, the driving power of the motor M is transmitted to the pressing roller gear 150G through the first drive train 601.

At this time, although the inner ring 672 of the second one-way clutch 670 meshed with the first driving input gear 550 is rotated, the inner ring 672 is slid relative to the outer ring 671. Therefore, the outer ring 671 of the second one-way clutch 670 is not rotated by the driving power from the pressing roller gear 150G and the driving power of the first driving input gear 550 is not transmitted to the second electromagnetic clutch 660. Thereby, it is possible to suppress a problem that may be caused as both the input gear 661 and the output gear 662 of the second electromagnetic clutch 660 at the disconnected state are rotated together.

On the other hand, when the second mode is selected, the first electromagnetic clutch 630 is at the disconnected state and the second electromagnetic clutch 660 is at the connected state. Therefore, as shown in FIG. 17B, the driving power of the motor M is transmitted to the pressing roller gear 150G through the second drive train 602.

At this time, although the inner ring 642 of the first one-way clutch 640 meshed with the first driving input gear 550 is rotated, the inner ring 642 is slid relative to the outer ring 641. Therefore, the outer ring 641 of the first one-way clutch 640 is not rotated by the driving power from the pressing roller gear 150G and the driving power of the first driving input gear 550 is not transmitted to the first electromagnetic clutch 630. Thereby, it is possible to suppress a problem that may be caused as both the input gear 631 and the output gear 632 of the first electromagnetic clutch 630 at the disconnected state are rotated together.

Meanwhile, in FIGS. 17A and 17B, both the first drive train 601 and the second drive train 602 have the first one-way clutches 640, 670. However, only one of the first drive train 601 and the second drive train 602 may have the one-way clutch and both the first drive train 601 and the second drive train 602 may not have the one-way clutch.

In the above descriptions, the present invention has been applied to the color printer 1. However, the present invention can also be applied to a variety of image forming apparatuses such as a copier, a complex machine and the like.

What is claimed is:

1. An image forming apparatus comprising:

an image forming unit configured to form an image on a sheet;

a fixing unit configured to convey and heat the sheet to fix the image on the sheet;

a planetary gear mechanism comprising a first element being configured to receive a first driving power and a second element being configured to receive a second driving power and a third element being configured to compose the first driving power received through the first element and the second driving power received through the second element and to output a composed driving power to the fixing unit, wherein the first element, the second element and the third element are configured by a group of elements comprising a sun gear, a carrier and a ring gear; and a rotation restraint mechanism configured to restrain rotation of the second element while the second element is not receiving the second driving power.

2. The image forming apparatus according to claim 1, wherein the rotation restraint mechanism comprises:

a swinging gear that is supported to be swingable around the second element and engageable with the second element; and an engaging part that is engageable with the swinging gear to restrain the rotation of the swinging gear.

3. The image forming apparatus according to claim 2, wherein the swinging gear is configured to swing toward a first position at which the swinging gear freely rotates when the second element receives the second driving power and to swing toward a second position at which the swinging gear engages with the second element when the second element is not receiving the second driving power.

4. The image forming apparatus according to claim 1 further comprising:

a motor configured to generate a driving power and to apply the first driving power to the first element.

5. The image forming apparatus according to claim 4 further comprising:

a sheet conveying unit configured to receive the driving power from the motor and to convey the sheet by utilizing the driving power.

6. The image forming apparatus according to claim 4, wherein the image forming unit comprises a photosensitive member having a surface on which a developer image is formed, the photosensitive member being configured to receive the driving power from the motor.

7. The image forming apparatus according to claim 4, wherein the motor applies the second driving power to the second element.

8. The image forming apparatus according to claim 1, wherein the fixing unit comprises:

a heating unit configured to be heated by a heat source;

a pressing roller configured to press the sheet conveyed between the heating unit and the pressing roller; and an urging member configured to urge one of the heating unit and the pressing roller towards the other, and wherein the pressing roller receives the driving power through the third element and rotates by utilizing the driving power.

9. The image forming apparatus according to claim 8, wherein the heating unit comprises an endless belt configured to be driven-rotated by the pressing roller by being pressed against the pressing roller and receiving the driving power through the pressing roller.

10. The image forming apparatus according to claim 1, wherein the first element is configured by one of the ring gear and the sun gear, wherein the second element is configured by the other of the ring gear and the sun gear, and wherein the third element is configured by the carrier.

11. The image forming apparatus according to claim 1, wherein the first element and the second element are configured to rotate in the same direction in a state where the first element receives the first driving power and the second element receives the second driving power.

* * * * *